US009128399B2

(12) United States Patent
Fukuri et al.

(10) Patent No.: US 9,128,399 B2
(45) Date of Patent: Sep. 8, 2015

(54) TONERS FOR ELECTROPHOTOGRAPHY

(71) Applicant: KAO CORPORATION, Chuo-ku (JP)

(72) Inventors: Norihiro Fukuri, Wakayama (JP); Osamu Yamashita, Wakayama (JP); Hiroki Kubo, Wakayama (JP); Shoichi Murata, Greensboro, NC (US); Takahiro Yoshikawa, Wakayama (JP)

(73) Assignee: KAO CORPORATION, Chuo-ku (JP)

( * ) Notice: Subject to any disclaimer, the term of this patent is extended or adjusted under 35 U.S.C. 154(b) by 0 days.

(21) Appl. No.: 13/827,967

(22) Filed: Mar. 14, 2013

(65) Prior Publication Data

US 2013/0273470 A1 Oct. 17, 2013

(30) Foreign Application Priority Data

Apr. 13, 2012 (JP) ..... 2012-092331

(51) Int. Cl.
*G03G 9/093* (2006.01)
*G03G 9/087* (2006.01)

(52) U.S. Cl.
CPC ..... *G03G 9/08755* (2013.01); *G03G 9/09328* (2013.01); *G03G 9/09371* (2013.01); *G03G 9/09392* (2013.01)

(58) Field of Classification Search
CPC ..... G03G 9/08755; G03G 9/08795; G03G 9/08797; G03G 9/09328; G03G 9/09371
USPC ..... 430/109.4, 110.1, 110.2
See application file for complete search history.

(56) References Cited

U.S. PATENT DOCUMENTS

2011/0104605 A1* 5/2011 Kim et al. ..... 430/108.4
2011/0229816 A1* 9/2011 Shirai et al. ..... 430/109.4

FOREIGN PATENT DOCUMENTS

JP 2004-326001 * 11/2004 ..... G03G 9/087
JP 1973-23405 9/2011
JP S48-23404 B 9/2011

OTHER PUBLICATIONS

Translation of JP 2004-326001 published Nov. 2004.*
U.S. Appl. No. 13/910,630, filed Jun. 5, 2013, Fukuri.
U.S. Appl. No. 13/910,592, filed Jun. 5, 2013, Fukuri.

* cited by examiner

*Primary Examiner* — Peter Vajda
(74) *Attorney, Agent, or Firm* — Oblon, McClelland, Maier & Neustadt, L.L.P.

(57) ABSTRACT

The present invention relates to a toner for electrophotography including core-shell particles as a resin binder each including a core portion containing an amorphous resin (A) having a softening point of 105° C. or lower which is obtained by polycondensing a carboxylic acid component containing an alkenyl succinic acid with an alcohol component; and a shell portion containing an amorphous resin (B) obtained by polycondensing an alcohol component containing an aliphatic diol having 2 to 6 carbon atoms with a carboxylic acid component containing a trivalent or higher-valent polycarboxylic acid compound in an amount of 20 mol % or less. The toner for electrophotography according to the present invention is excellent in heat resistant storage property, low-temperature fusing property and durability.

21 Claims, No Drawings

TONERS FOR ELECTROPHOTOGRAPHY

CROSS REFERENCES TO RELATED APPLICATIONS

This application claims priority to Japanese Patent Application No. 2012-092331, filed on Apr. 13, 2012.

FIELD OF THE INVENTION

The present invention relates to toners for electrophotography, and a process for producing the toners for electrophotography.

BACKGROUND OF THE INVENTION

Toners are required to have a good heat-resistant storage property and a good low-temperature fusing property which are contradictory to each other. In order to satisfy both the contradictory properties, there have been proposed toners having a core-shell structure including a core portion and a shell portion covering the core portion.

For example, Patent Document 1 discloses a resin binder for toners in the form of core-shell particles each including a core portion containing an amorphous resin obtained by polycondensing a carboxylic acid component containing at least one of an alkyl succinic acid and an alkenyl succinic acid with an alcohol component, and a crystalline polyester, and a shell portion containing an amorphous resin obtained by polycondensing an alcohol component containing an aliphatic dialcohol with a carboxylic acid component. In Patent Document 1, it is described that the reason why the alkyl succinic acid or the like is used as the carboxylic acid component of the amorphous resin constituting the core portion is that the crystalline polyester contained in the core portion can be finely dispersed in the amorphous resin constituting the core portion and enclosed in the core-shell structure so that the resulting toner can be enhanced in high anti-staining property for carriers and charging rate.

Also, in Patent Document 2, it is described that when using an alkyl succinic acid or an alkenyl succinic acid as a carboxylic acid component of an amorphous resin of a core portion, it is possible to enhance a compatibility between the amorphous resin and a crystalline polyester contained in the core portion.

Patent Document 3 discloses a process for producing a toner which includes a first aggregation step of aggregating resin fine particles containing an amorphous polyester resin to produce a dispersion of a first precursor of toner particles, a mixing step of mixing the dispersion of the first precursor of toner particles with a dispersion of carboxyl group-containing polyester resin fine particles to produce a dispersion of a second precursor of toner particles, and a second aggregation step of aggregating the second precursor of toner particles to form toner particles for the purpose of enhancing a low-temperature fusing property, a heat-resistant storage property, an anti-breaking property and an anti-filming property of the resulting toner and suppressing occurrence of dusts and scattering of the toner.

Patent Document 1: JP 2011-197193A
Patent Document 2: JP 2011-197192A
Patent Document 3: JP 2010-145611A

SUMMARY OF THE INVENTION

The present invention relates to the following aspects [1] and [2]. [1] A toner for electrophotography including core-shell particles as a resin binder each including a core portion containing an amorphous resin (A) having a softening point of 105° C. or lower which is obtained by polycondensing a carboxylic acid component containing an alkenyl succinic acid with an alcohol component; and a shell portion containing an amorphous resin (B) obtained by polycondensing an alcohol component containing an aliphatic diol having 2 to 6 carbon atoms with a carboxylic acid component containing a trivalent or higher-valent polycarboxylic acid compound in an amount of 20 mol % or less. [2] A process for producing a toner for electrophotography, including the following steps 1 to 4:

Step 1: subjecting a resin aqueous dispersion containing an amorphous resin (A) having a softening point of 105° C. or lower which is obtained by polycondensing a carboxylic acid component containing an alkenyl succinic acid with an alcohol component to aggregation of the resin to prepare an aqueous dispersion of resin particles I;

Step 2: preparing a resin aqueous dispersion containing an amorphous resin (B) obtained by polycondensing an alcohol component containing an aliphatic diol having 2 to 6 carbon atoms with a carboxylic acid component containing a trivalent or higher-valent polycarboxylic acid compound in an amount of 20 mol % or less;

Step 3: mixing the aqueous dispersion of the resin particles I obtained in the step 1 with the resin aqueous dispersion containing the amorphous resin (B) obtained in the step 2 to aggregate the resin particles I and the amorphous resin (B), thereby preparing an aqueous dispersion of resin particles II; and Step 4: coalescing the resin particles II obtained in the step 3.

DETAILED. DESCRIPTION OF THE INVENTION

As described in Patent Documents 1 and 2, there have been made studies on toners having a core-shell structure in which by using a crystalline polyester in a core portion of the core-shell structure, a softening point of the core portion is reduced to improve a low-temperature fusing property of the toner. However, when such a crystalline polyester serving as a plasticizable portion is contained in the toners, the resulting toners tend to be deteriorated in durability. For this reason, it has been required to develop toners capable of exhibiting excellent heat-resistant storage property, low-temperature fusing property and durability regardless of the presence or absence of the crystalline polyester.

The present invention relates to a toner for electrophotography which is excellent in heat resistant storage property, low-temperature fusing property and durability, as well as a process for producing the toner for electrophotography.

The present inventors have found that in a toner having a core-shell structure including a core portion and a shell portion, when an alkenyl succinic acid is used as a carboxylic acid component of an amorphous resin constituting the core portion and an aliphatic diol having 2 to 6 carbon atoms is used as an alcohol component of an amorphous resin constituting the shell portion, it is possible to obtain a toner for electrophotography which is excellent in heat resistant storage property, low-temperature fusing property and durability.

The toner for electrophotography according to the present invention includes core-shell particles as a resin binder each including a core portion containing an amorphous resin (A) having a softening point of 105° C. or lower which is obtained by polycondensing a carboxylic acid component containing an alkenyl succinic acid with an alcohol component; and a shell portion containing an amorphous resin (B) obtained by polycondensing an alcohol component containing an aliphatic diol having 2 to 6 carbon atoms with a carboxylic acid component containing a trivalent or higher-valent polycarboxylic acid compound in an amount of 20 mol % or less.

The reason why the toner for electrophotography according to the present invention is excellent in heat-resistant storage property, low-temperature fusing property and durability, is considered as follows.

That is, since the alkenyl succinic acid is used as the carboxylic acid component of the amorphous resin (A) constituting the core portion, in the case where a softening point of the amorphous resin (A) is adjusted to 105° C. or lower, a glass transition point of the resin becomes lower than that of a resin obtained using no alkenyl succinic acid even if the softening points of both the resins are the same. As a result, it is considered that the resulting toner can be enhanced in low-temperature fusing property. Further, in addition to the use of the alkenyl succinic acid in the amorphous resin (A), since the aliphatic diol especially having 2 to 6 carbon atoms is used as the alcohol component of the amorphous resin (B) constituting the shell portion, a compatibility between the core portion and the shell portion can be reduced to an appropriate extent so that the core-shell structure of the toner can be well maintained to allow the core portion and the shell portion to suitably exhibit their respective functions. As a result, it is considered to enable production of a toner for electrophotography which is excellent in heat-resistant storage property, low-temperature fusing property and durability.

In addition, when the trivalent or higher-valent carboxylic acid compound is contained merely in a small amount, the resulting resin forms a good cross-linked structure so that a molecular weight thereof can be increased or maintained. However, if a large mount of the trivalent or higher-valent carboxylic acid compound is contained, it is considered that the resulting resin has a wide molecular weight distribution and therefore a large amount of low-molecular weight components are produced. On the other hand, since the low-molecular weight components tend to be miscible with various resins, the presence of the low-molecular weight components may increase the above compatibility between the core portion and the shell portion. In the present invention, since the content of the trivalent or higher-valent carboxylic acid compound in the amorphous resin (B) used in the shell portion is limited to a predetermined amount or less, the resulting resin can be prevented from exhibiting a wide molecular weight distribution, in particular, can be prevented from suffering from production of the low-molecular weight components. As a result, it is considered that the above core-shell structure can be maintained, so that a toner for electrophotography which is excellent in heat-resistant storage property, low-temperature fusing property and durability can be obtained.

[Resin Binder]

The resin binder for toners according to the present invention includes core-shell particles which each includes a core portion containing the amorphous resin (A) and a shell portion containing the amorphous resin (B).

<Core Portion>

(Amorphous Resin (A))

The amorphous resin (A) is obtained by polycondensing a carboxylic acid component containing an alkenyl succinic acid with an alcohol component, and has a softening point of 105° C. or lower. Thus, by reducing a softening point of the amorphous resin (A) to 105° C. or lower, it is possible to enhance a low-temperature fusing property of the resulting toner.

[Carboxylic Acid Component]

The carboxylic acid component as a raw material monomer of the amorphous resin (A) contains an alkenyl succinic acid. By using the alkenyl succinic acid in the amorphous resin (A), in the case where the softening point of the amorphous resin (A) is adjusted to 105° C. or lower, the glass transition point of the resulting resin becomes lower than that of a polyester resin used in the conventional toners, so that the obtained toner can be enhanced in low-temperature fusing property. Meanwhile, the alkenyl succinic acid used in the present invention may also include an alkenyl succinic anhydride.

<<Alkenyl Succinic Acid>>

The number of carbon atoms contained in an alkenyl group of the alkenyl succinic acid is preferably from 9 to 18, more preferably from 9 to 14 and still more preferably from 10 to 12 from the viewpoints of good heat-resistant storage property, low-temperature fusing property and durability of the resulting toner.

The alkenyl group may have either a straight-chain structure or a branched-chain structure, and preferably has a branched-chain structure from the viewpoints of good heat-resistant storage property, low-temperature fusing property and durability of the resulting toner.

In addition, from the viewpoints of good heat-resistant storage property, low-temperature fusing property and durability of the resulting toner, the alkenyl succinic acid is preferably in the form of a mixture of two or more kinds of alkenyl succinic acids. The term "kinds" used herein is intended to mean those derived from an alkenyl group, and those compounds that are different in carbon chain length of the alkenyl group or structural isomers thereof may be dealt with herein as different kinds of alkenyl succinic acids.

Therefore, the alkenyl succinic acid is preferably in the form of a mixture of two or more kinds of alkenyl succinic acids containing a branched alkenyl group having preferably 9 to 18 carbon atoms, more preferably 9 to 14 carbon atoms and still more preferably 10 to 12 carbon atoms from the viewpoints of good heat-resistant storage property, low-temperature fusing property and durability of the resulting toner. By using combination of two or more kinds of alkenyl succinic acids containing branched alkenyl groups which are different in number of carbon atoms from each other, the resulting resin exhibits a broad endothermic peak observed in the vicinity of a glass transition point thereof as measured by differential scanning calorimetry (DSC) and therefore can provide a resin binder for toners which can exhibit a very extensive fusing temperature range.

Specific examples of the branched alkenyl group having 9 to 18 carbon atoms include an isododecenyl group or the like.

From the viewpoints of good heat-resistant storage property, low-temperature fusing property and durability of the resulting toner, the alkenyl succinic acid is preferably produced by reacting an alkylene group-containing compound (alkylene compound) and at least one compound selected from the group consisting of maleic acid, fumaric acid and anhydrides of these acids.

Examples of the alkylene compound include those alkylene compounds having 9 to 18 carbon atoms, preferably 9 to 14 carbon atoms and more preferably 10 to 12 carbon atoms from the viewpoints of good heat-resistant storage property, low-temperature fusing property and durability of the resulting toner. Specific examples of the alkylene compound include those alkylene compounds obtained from ethylene, propylene, isobutylene, n-butylene, etc., for example, there are preferably used trimers and tetramers of these compounds, etc. As the suitable raw material used for synthesis of the alkylene compound, there is preferably used propylene having a small molecular weight from the viewpoint of increasing the number of structural isomers thereof. From the viewpoint of allowing the polycondensation-based resin obtained by using the alkenyl succinic acid to exhibit a very extensive fusing temperature range when used as a resin binder for toners, the alkylene compound preferably exhibits 2 or more peaks corresponding to the alkylene compounds having 9 to 18 carbon atoms, preferably 9 to 14 carbon atoms and more preferably 10 to 12 carbon atoms as measured by gas chromatography-mass spectrometry under the below-mentioned conditions. The number of the peaks observed in the above analysis is more preferably 10 or more, still more preferably 20 or more and further still more preferably 30 or more, and is preferably 80 or less and more preferably 60 or less.

The content of the alkenyl succinic acid in the carboxylic acid component of the amorphous resin (A) is preferably 5 mol % or more, more preferably 10 mol % or more, still more preferably 15 mol % or more, further still more preferably 20 mol % or more, and further still more preferably 25 mol % or more from the viewpoint of a good low-temperature fusing property of the resulting toner, and preferably 60 mol % or less, more preferably 50 mol % or less, still more preferably 45 mol % or less, and further still more preferably 40 mol % or less from the viewpoint of good heat-resistant storage property and durability of the resulting toner. Therefore, from these viewpoints in total, the content of the alkenyl succinic acid in the carboxylic acid component of the amorphous resin (A) is preferably 5 mol % or more, more preferably from 5 to 60 mol %, still more preferably from 10 to 50 mol %, further still more preferably from 15 to 45 mol %, further still more preferably from 20 to 45 mol % and further still more preferably from 25 to 40 mol %.

The molar amount of the alkenyl succinic acid used is preferably 5 mol parts or more, more preferably 10 mol parts or more, still more preferably 15 mol parts or more, further still more preferably 20 mol parts or more and further still more preferably 25 mol parts or more, and is preferably 60 mol parts or less, more preferably 50 mol parts or less, still more preferably 45 mol parts or less and further still more preferably 40 mol parts or more on the basis of 100 mol parts of the alcohol component of the amorphous resin (A) from the viewpoints of good heat-resistant storage property, low-temperature fusing property and durability of the resulting toner. More specifically, the molar amount of the alkenyl succinic acid is preferably from 20 to 60 mol parts, more preferably from 25 to 50 mol parts, still more preferably from 25 to 45 mol parts and further still more preferably from 25 to 40 mol parts on the basis of 100 mol parts of the alcohol component of the amorphous resin (A).

<<Method for Producing Alkenyl Succinic Acid>>

The alkyl succinic acid may be produced by an optional method, for example, by using an ene reaction in which the alkylene compound is mixed with at least one compound selected from the group consisting of maleic acid, fumaric acid and anhydrides of these acids, followed by heating the resulting mixture (refer to JP S48-23405B, JP S48-23404B, U.S. Pat. No. 3,374,285, etc.).

Among maleic acid, fumaric acid and anhydrides of these acids, preferred is maleic anhydride from the viewpoint of a good reactivity.

Examples of a catalyst suitably used for synthesis of the alkylene compound include liquid phosphoric acid, solid phosphoric acid, tungsten and a boron trifluoride complex. Meanwhile, from the viewpoint of readily controlling the number of structural isomers of the alkenyl succinic acid produced, there is preferably used the production method in which distillation is carried out after the random polymerization.

<<Carboxylic Acid Component Other than Alkenyl Succinic Acid>>

The carboxylic acid component may also contain, in addition to the alkenyl succinic acid, at least one compound selected from the group consisting of an alkyl succinic acid, the other dicarboxylic acid compound and a trivalent or higher-valent polycarboxylic acid compound.

The number of carbon atoms of an alkyl group of the alkyl succinic acid or inclusion or non-inclusion of a branched chain therein are the same as those of the alkenyl group of the alkenyl succinic acid. A preferred alkyl group of the alkyl succinic acid is an isododecyl group.

Examples of the other dicarboxylic acid compound include aliphatic dicarboxylic acids such as oxalic acid, malonic acid, maleic acid, fumaric acid, citraconic acid, itaconic acid, glutaconic acid, succinic acid, adipic acid, sebacic acid and azelaic acid; aromatic dicarboxylic acids such as phthalic acid, isophthalic acid and terephthalic acid; alicyclic dicarboxylic acids such as cyclohexanedicarboxylic acid; and anhydrides and alkyl ($C_1$ to $C_3$) esters of these acids. Among these dicarboxylic acid compounds, from the viewpoints of good heat-resistant storage property, low-temperature fusing property and durability of the resulting toner, preferred are aliphatic dicarboxylic acids and aromatic dicarboxylic acids, and more preferred are aromatic dicarboxylic acid compounds. More specifically, among the above dicarboxylic acid compounds, preferred are fumaric acid, phthalic acid, isophthalic acid and terephthalic acid, more preferred are phthalic acid, isophthalic acid and terephthalic acid, and still more preferred is terephthalic acid. In the present invention, the above acids and the above anhydrides and alkyl esters of these acids are generally referred to as a "carboxylic acid compound".

The content of the aromatic dicarboxylic acid compound in the carboxylic acid component of the amorphous resin (A) is preferably 20 mol % or more, more preferably 35 mol % or more and still more preferably 40 mol % or more, and is preferably 90 mol % or less, more preferably 80 mol % or less, still more preferably 75 mol % or less, further still more preferably 70 mol % or less, further still more preferably 65 mol % or less and further still more preferably 60 mol % or less from the viewpoints of good heat-resistant storage property, low-temperature fusing property and durability of the resulting toner. Therefore, more specifically, the content of the aromatic dicarboxylic acid compound in the carboxylic acid component of the amorphous resin (A) is preferably from 30 to 90 mol %, more preferably from 35 to 80 mol % and still more preferably from 40 to 75 mol %.

Examples of the trivalent or higher-valent polycarboxylic acid compound include aromatic carboxylic acids such as 1,2,4-benzenetricarboxylic acid (trimellitic acid), 2,5,7-naphthalenetricarobxylic acid and pyromellitic acid; and derivatives of these acids such as anhydrides and alkyl ($C_1$ to $C_3$) esters of these acids.

Examples of the other carboxylic acid compounds include unpurified rosin, purified rosin and rosins modified with fumaric acid, maleic acid, acrylic acid, etc.

In the present invention, the carboxylic acid component preferably contains the trivalent or higher-valent polycarboxylic acid compound, more preferably a trimellitic acid compound and still more preferably trimellitic anhydride from the viewpoints of increasing a molecular weight of the resin and enhancing a heat-resistant storage property and a durability of the resulting toner. For the same viewpoints, the content of the trivalent or higher-valent polycarboxylic acid compound in the carboxylic acid component is preferably from 0.1 to 30 mol %, more preferably from 1 to 25 mol % and still more preferably from 5 to 20 mol %.

[Alcohol Component]

The alcohol component as a raw material monomer of the amorphous resin (A) is not particularly limited, and may be either an aliphatic alcohol or an aromatic alcohol. From the viewpoints of enhancing a heat-resistant storage property, a low-temperature fusing property and a durability of the resulting toner when used together with the alkenyl succinic acid, the alcohol component preferably contains an aliphatic diol, more preferably an aliphatic diol having 2 to 6 carbon atoms.

Examples of the aliphatic diol having 2 to 6 carbon atoms include ethylene glycol, 1,2-propanediol, 1,3-propanediol, 1,2-butanediol, 1,3-butanediol, 1,4-butanediol, 2,3-butanediol, 1,2-pentanediol, 1,3-pentanediol, 1,4-pentanediol, 1,5-pentanediol, neopentyl glycol, 2,3-pentanediol, 2,4-pentanediol, 1,2-hexanediol, 1,3-hexanediol, 1,4-hexanediol, 1,5-hexanediol and 1,6-hexanediol. Among these aliphatic diols, from the viewpoints of enhancing a heat-resistant storage property, a low-temperature fusing property and a durability of the resulting toner, preferred are 2,3-butanediol, 1,2-propanediol, 1,6-hexanediol, neopentyl glycol and ethylene glycol.

When using the aliphatic diol having 2 to 6 carbon atoms as the alcohol component, the content of the aliphatic diol having 2 to 6 carbon atoms in the alcohol component is preferably from 80 to 100 mol %, more preferably from 90 to 100 mol % and still more preferably from 95 to 100 mol % from the viewpoints of good heat-resistant storage property, low-temperature fusing property and durability of the resulting toner.

The aliphatic diol having 2 to 6 carbon atoms preferably contains an aliphatic diol having 2 to 4 carbon atoms, and more preferably is composed of the aliphatic diol having 2 to 4 carbon atoms only.

In addition, the alcohol component of the amorphous resin (A) preferably contains an aliphatic diol containing a hydroxyl group bonded to a secondary carbon atom, and more preferably is composed of the aliphatic diol containing a hydroxyl group bonded to a secondary carbon atom only. Therefore, the aliphatic diol having 2 to 6 carbon atoms and the aliphatic diol having 2 to 4 carbon atoms both preferably contain the aliphatic diol containing a hydroxyl group bonded to a secondary carbon atom, and more preferably are composed of the aliphatic diol containing a hydroxyl group bonded to a secondary carbon atom only.

Examples of the alcohol components other than the aliphatic diol having 2 to 6 carbon atoms include an aliphatic diol having 7 or more carbon atoms, a trivalent or higher-valent alcohol such as glycerin, and an alkyleneoxide adduct of bisphenol A represented by the following formula (I).

(I)

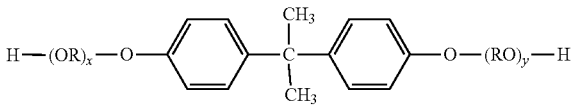

wherein RO and OR are respectively an oxyalkylene group; R is an ethylene group and/or a propylene group; x and y each represent a molar number of addition of alkyleneoxides and are each a positive number with the proviso that an average value of a sum of x and y is preferably from 1 to 16, more preferably from 1 to 8 and still more preferably from 1.5 to 4.

Specific examples of the alkyleneoxide adduct of bisphenol A represented by the above formula (I) include a polyoxypropylene adduct of 2,2-bis(4-hydroxyphenyl)propane and a polyoxyethylene adduct of 2,2-bis(4-hydroxyphenyl)propane.

The content of the alkyleneoxide adduct of bisphenol A in the alcohol component in the case where the above aliphatic diol is not used therein is preferably from 80 to 100 mol %, more preferably from 90 to 100 mol % and still more preferably from 95 to 100 mol % from the viewpoints of good heat-resistant storage property and durability of the resulting toner.

As the alcohol components other than the above aliphatic diol and alkyleneoxide adduct of bisphenol A, there are preferably used an aliphatic diol having 7 or more carbon atoms and a trivalent or higher-valent alcohol such as glycerin.

[Molar Ratio Between Alcohol Component and Carboxylic Acid Component]

The molar ratio of the carboxylic acid component to the alcohol component (carboxylic acid component/alcohol component) in the amorphous resin (A) is preferably from 0.7 to 1.2, more preferably from 0.8 to 1.1 and still more preferably from 0.85 to 1 from the viewpoints of enhancing a heat-resistant storage property, a low-temperature fusing property and a durability of the resulting toner.

(Modified Amorphous Resin)

The amorphous resin (A) used in the present invention may also contain a modified amorphous resin.

Examples of the modified amorphous resin include urethane-modified polyesters obtained by modifying a polyester resin with a urethane bond, epoxy-modified polyesters obtained by modifying a polyester with an epoxy bond, and hybrid resins containing two or more kinds of resins including a polyester component.

(Crystalline Polyester)

As described above, according to the present invention, by using the alkenyl succinic acid as the carboxylic acid component of the amorphous resin constituting the core portion and using the aliphatic diol having 2 to 6 carbon atoms as the alcohol component of the amorphous resin constituting the shell portion, it is possible to obtain a toner for electrophotography which is excellent in heat-resistant storage property, low-temperature fusing property and durability regardless of the presence or absence of the crystalline polyester. Also, the core portion may contain the crystalline polyester in such an extent that addition of the crystalline polyester to the core portion has no adverse influence on the effects of the present invention. However, from the viewpoints of improving a heat-resistant storage property, a low-temperature fusing property and a durability of the resulting toner in a well-balanced manner, the core portion preferably contains no crystalline polyester.

The kind of an alcohol component of the crystalline polyester is the same as that of the alcohol component of the amorphous resin (A). From the viewpoint of a high crystallinity of the resin, 1,6-hexanediol is preferably used as the alcohol component. The kind of a carboxylic acid component of the crystalline polyester is also the same as that of the carboxylic acid component of the amorphous resin (A). From the viewpoint of a high crystallinity of the resin, fumaric acid is preferably used as the carboxylic acid component.

The crystalline polyester as used in the present invention means a resin having a ratio of a softening point to an endothermic highest peak temperature (softening point (° C.)/endothermic highest peak temperature (° C.)) of from 0.6 to 1.3, preferably from 0.9 to 1.2, and more preferably from 1.0 to 1.2 as measured by the method described below in Examples.

Also, the amorphous resin as used herein means a resin having a ratio of a softening point to an endothermic highest peak temperature (softening point (° C.)/endothermic highest peak temperature (° C.)) of more than 1.3 or less than 0.6, preferably more than 1.3 and not more than 4, and more preferably from 1.5 to 3.

[Properties of Crystalline Polyester]

The number-average molecular weight of the crystalline polyester used in the present invention is not particularly limited, and is preferably from 1,000 to 6,000, more preferably from 1,000 to 5,000 and still more preferably from 1,500 to 4,500 from the viewpoints of enhancing a heat-resistant storage property, a low-temperature fusing property and a durability of the resulting toner. Also, from the same viewpoints as those for the number-average molecular weight, the weight-average molecular weight of the crystalline polyester is preferably from 3,000 to 100,000, more preferably from 4,500 to 50,000, still more preferably from 5,000 to 30,000 and further still more preferably from 6,000 to 20,000.

Meanwhile, in the present invention, the number-average molecular weight and the weight-average molecular weight of the crystalline polyester respectively mean the values as measured with respect to a chloroform soluble component in the crystalline polyester.

From the viewpoints of good heat-resistant storage property, low-temperature fusing property and durability of the resulting toner, the crystalline polyester used in the present invention preferably has a softening point of from 60 to 160° C., more preferably from 80 to 140° C., still more preferably from 100 to 120° C. and further still more preferably from 110 to 120° C.

The melting point of the crystalline polyester used in the present invention is preferably from 60 to 150° C., more preferably from 80 to 130° C., still more preferably from 100 to 120° C. and further still more preferably from 105 to 115° C. from the viewpoints of good heat-resistant storage property, low-temperature fusing property and durability of the resulting toner.

The acid value of the crystalline polyester used in the present invention is preferably from 1 to 40 mg KOH/g, more preferably from 2 to 35 mg KOH/g and still more preferably from 3 to 30 mg KOH/g from the viewpoint of a good dispersibility of the crystalline polyester in the aqueous dispersion.

The number-average molecular weight, softening point, melting point and acid value of the crystalline polyester may be readily adjusted by appropriately controlling a composition of the raw material monomers, a polymerization initiator, a molecular weight, an amount of a catalyst used, etc., or selecting suitable reaction conditions.

[Releasing Agent]

The core portion of the core-shell particles may contain a releasing agent.

When using the releasing agent in the core portion, the mass ratio of the releasing agent to the whole resin binder containing the amorphous resin (A) in the core portion [releasing agent/whole resin binder containing the amorphous resin (A)] is preferably from 0.1/100 to 10/100, more preferably from 0.5/100 to 5/100 and still more preferably from 1/100 to 3/100 from the viewpoints of good heat-resistant storage property, low-temperature fusing property and durability of the resulting toner.

The mass ratio of the releasing agent to the amorphous resins [(A)+(B)] in the core-shell particles (releasing agent/amorphous resins [(A)+(B)]) is preferably from 0.1/100 to 10/100, more preferably from 0.5/100 to 5/100 and still more preferably from 1/100 to 2/100 from the viewpoints of good heat-resistant storage property, low-temperature fusing property and durability of the resulting toner.

Examples of the releasing agent include low-molecular weight polyolefins such as polyethylene, polypropylene and polybutene; silicones exhibiting a softening point by heating; fatty acid amides such as oleamide, erucamide, ricinolamide and stearamide; vegetable waxes such as carnauba wax, rice wax, candelilla wax, haze wax and jojoba oil; animal waxes such as beeswax; and mineral and petroleum-based waxes such as montan wax, paraffin wax, ozokerite, ceresin, microcrystalline wax and Fischer-Tropsch wax. Among these releasing agents, paraffin wax is preferably used from the viewpoint of a good availability. These releasing agents may be used alone or in combination of any two or more thereof.

The releasing agent is preferably used in the form of a dispersion of releasing agent particles prepared by dispersing the releasing agent in an aqueous medium from the viewpoints of a good dispersibility thereof as well as a good aggregating property of the releasing agent with the resin particles.

<Shell Portion>

(Amorphous Resin (B))

The amorphous resin (B) is obtained by polycondensing an alcohol component containing an aliphatic diol having 2 to 6 carbon atoms with a carboxylic acid component containing a trivalent or higher-valent polycarboxylic acid compound in an amount of 20 mol % or less.

[Carboxylic Acid Component]

The carboxylic acid component of the amorphous resin (B) preferably contains a dicarboxylic acid compound. Examples of the dicarboxylic acid compound include aliphatic dicarboxylic acids such as oxalic, acid, malonic acid, maleic acid, fumaric acid, citraconic acid, itaconic acid, glutaconic acid, succinic acid, adipic acid, sebacic acid and azelaic acid; aromatic dicarboxylic acids such as phthalic acid, isophthalic acid and terephthalic acid; alicyclic dicarboxylic acids such as cyclohexanedicarboxylic acid; and anhydrides and alkyl ($C_1$ to $C_3$) esters of these acids. Among these dicarboxylic acid compounds, from the viewpoints of good heat-resistant storage property, low-temperature fusing property and durability of the resulting toner, preferred are aliphatic dicarboxylic acids and aromatic dicarboxylic acids, and more preferred are aromatic dicarboxylic acid compounds. More specifically, among the above dicarboxylic acid compounds, preferred are fumaric acid, phthalic acid, isophthalic acid and terephthalic acid, more preferred are phthalic acid, isophthalic acid and terephthalic acid, and still more preferred are isophthalic acid and terephthalic acid.

Examples of the other carboxylic acid component of the amorphous resin (B) include an alkyl succinic acid and a trivalent or higher-valent polycarboxylic acid compound. The carboxylic acid component and the other carboxylic acid component of the amorphous resin (B) are the same as those described above with respect to the amorphous resin (A).

The amorphous resin (B) may also contain an alkenyl succinic acid as the carboxylic acid component thereof. However, from the viewpoints of raising a softening point of the shell portion and improving a heat-resistant storage property and a durability of the resulting toner, the amount (mol parts) of the alkenyl succinic acid contained as the carboxylic acid component in the amorphous resin (B) on the basis of 100 mol parts of the alcohol component of the amorphous resin (B) is preferably smaller than the amount (mol parts) of the alkenyl succinic acid contained as the carboxylic acid component in the amorphous resin (A) on the basis of 100 mol parts of the alcohol component of the amorphous resin (A), and is more preferably 5 mol parts or less and still more preferably 1 mol part or less. It is further still more preferred that the amorphous resin (B) contains no alkenyl succinic acid.

The details of the alkenyl succinic acid contained in the amorphous resin (B) are the same as those described above with respect to the amorphous resin (A).

The carboxylic acid component of the amorphous resin (B) preferably contain an aromatic dicarboxylic acid compound from the viewpoints of good heat-resistant storage property, low-temperature fusing property and durability of the resulting toner. The content of the aromatic dicarboxylic acid compound in the carboxylic acid component is preferably from 30 to 95 mol %, more preferably from 55 to 92 mol %, still more preferably from 70 to 90 mol % and further still more preferably from 80 to 90 mol % from the viewpoints of good heat-resistant storage property, low-temperature fusing property and durability of the resulting toner.

Examples of the other carboxylic acid compound of the amorphous resin (B) include unpurified rosin, purified rosin and rosins modified with fumaric acid, maleic acid, acrylic acid, etc.

In the present invention, from the viewpoints of improving a heat-resistant storage property, a low-temperature fusing property and a durability of the resulting toner, the content of the trivalent or higher-valent polycarboxylic acid compound in the carboxylic acid component of the amorphous resin (B) is 20 mol % or less, more preferably 19 mol % or less, still more preferably 15/0.85 mol % or less, further still more preferably 15 mol % or less and further still more preferably 13 mol % or less. The "20 mol % or less" as used herein means both "the trivalent or higher-valent polycarboxylic acid compound is contained in the carboxylic acid component and the amount of the trivalent or higher-valent polycarboxylic acid compound in the carboxylic acid component is 20 mol % or less" and "the trivalent or higher-valent polycarboxylic acid compound is not contained in the carboxylic acid component." More specifically, the content of the trivalent or higher-valent polycarboxylic acid compound in the carboxylic acid component of the amorphous resin (B) is preferably from 0 to 20 mol %, and more preferably from 1 to 20 mol %. Further, from the viewpoints of good low-temperature fusing property and durability of the resulting toner, the content of the trivalent or higher-valent polycarboxylic acid compound in the carboxylic acid component of the amorphous resin (B) is preferably from 1 to 19 mol %, more preferably from 1 to 15/0.85 mol %, still more preferably from 5 to 15 mol % and further still more preferably from 5 to 13 mol %.

In the present invention, from the viewpoints of improving a heat-resistant storage property, a low-temperature fusing property and a durability of the resulting toner, the content of the trivalent or higher-valent polycarboxylic acid compound in the carboxylic acid component of the amorphous resin (B) is preferably 20 mol % or less, more preferably 19 mol % or less, still more preferably 15 mol % or less and further still more preferably 13 mol % or less on the basis of 100 mol % of the alcohol component of the amorphous resin (B). More specifically, the content of the trivalent or higher-valent polycarboxylic acid compound in the carboxylic acid component of the amorphous resin (B) is preferably from 0 to 20 mol %, and more preferably from 1 to 20 mol % on the basis of 100 mol % of the alcohol component of the amorphous resin (B). Further, from the viewpoints of good low-temperature fusing property and durability of the resulting toner, the content of the trivalent or higher-valent polycarboxylic acid compound in the carboxylic acid component of the amorphous resin (B) is preferably from 1 to 19 mol %, more preferably from 1 to 15 mol % and still more preferably from 5 to 13 mol % on the basis of 100 mol % of the alcohol component of the amorphous resin (B).

Examples of the trivalent or higher-valent polycarboxylic acid compounds include aromatic carboxylic acids such as 1,2,4-benzenetricarboxylic acid (trimellitic acid), 2,5,7-naphthalenetricarobxylic acid and pyromellitic acid; and derivatives of these acids such as anhydrides and alkyl ($C_1$ to $C_3$) esters of these acids. Among these trivalent or higher-valent polycarboxylic acid compounds, preferred are trimellitic acid compounds, and more preferred is trimellitic anhydride.

[Alcohol Component]

The alcohol component as a raw material monomer of the amorphous resin (B) contains an aliphatic diol having 2 to 6 carbon atoms.

As described above, by using the aliphatic diol having 2 to 6 carbon atoms in the amorphous resin (B) and using the alkenyl succinic acid in the amorphous resin (A), the compatibility between the core portion and the shell portion may be reduced to an appropriate extent and therefore the core-shell structure of the toner can be suitably maintained, so that it is possible to well exhibit respective functions of the core portion and the shell portion. As a result, it is considered that a toner for electrophotography which is excellent in heat-resistant storage property, low-temperature fusing property and durability can be obtained.

Examples of the aliphatic diol having 2 to 6 carbon atoms include ethylene glycol, 1,2-propanediol, 1,3-propanediol, 1,2-butanediol, 1,3-butanediol, 1,4-butanediol, 2,3-butanediol, 1,2-pentanediol, 1,3-pentanediol, 1,4-pentanediol, 1,5-pentanediol, neopentyl glycol, 2,3-pentanediol, 2,4-pentanediol, 1,2-hexanediol, 1,3-hexanediol, 1,4-hexanediol, 1,5-hexanediol and 1,6-hexanediol. Among these aliphatic diols, from the viewpoints of enhancing a heat-resistant storage property, a low-temperature fusing property and a durability of the resulting toner, preferred are 2,3-butanediol, 1,2-propanediol, 1,6-hexanediol, neopentyl glycol and ethylene glycol.

From the viewpoints of good low-temperature fusing property and durability of the resulting toner, the amount of the aliphatic diol having 2 to 6 carbon atoms added is from 80 to 100 mol %, more preferably from 90 to 100 mol % and still more preferably from 95 to 100 mol % on the basis of the alcohol component as the raw material monomer of the amorphous resin (B).

The details of the aliphatic diol having 2 to 6 carbon atoms and the other alcohol components are the same as those described above with respect to the amorphous resin (A).

The aliphatic diol having 2 to 6 carbon atoms preferably contains an aliphatic diol having 2 to 4 carbon atoms, and more preferably is composed of the aliphatic diol having 2 to 4 carbon atoms only.

The content of the aliphatic diol having 2 to 4 carbon atoms in the alcohol component of the amorphous resin (B) is preferably from 80 to 100 mol %, more preferably from 90 to 100 mol %, still more preferably from 95 to 100 mol %, further still more preferably from 99 to 100 mol % and most preferably 100 mol %.

The alcohol component of the amorphous resin (B) preferably contains an aliphatic diol containing a hydroxyl group bonded to a secondary carbon atom, and more preferably is composed of the aliphatic diol containing a hydroxyl group bonded to a secondary carbon atom only. Therefore, the aliphatic diol having 2 to 6 carbon atoms and the aliphatic diol having 2 to 4 carbon atoms both preferably contain the aliphatic diol containing a hydroxyl group bonded to a secondary carbon atom, and more preferably are composed of the aliphatic diol containing a hydroxyl group bonded to a secondary carbon atom only.

<Properties of Amorphous Resins (A) and (B)>

The number-average molecular weight of the amorphous resin (A) is preferably from 1,000 to 6,000, more preferably from 2,000 to 5,000 and still more preferably from 2,200 to 4,000 from the viewpoints of enhancing a heat-resistant storage property, a low-temperature fusing property and a durability of the resulting toner. Also, the weight-average molecular weight of the amorphous resin (A) is preferably 6,000 or more, more preferably from 8,000 to 1,000,000, still more preferably from 8,000 to 100,000 and further still more preferably from 10,000 to 50,000 from the viewpoints of enhancing a heat-resistant storage property, a low-temperature fusing property and a durability of the resulting toner.

The number-average molecular weight of the amorphous resin (B) is preferably from 1,000 to 6,000, more preferably from 2,000 to 5,000 and still more preferably from 2,200 to 4,000 from the viewpoints of enhancing a heat-resistant storage property, a low-temperature fusing property and a durability of the resulting toner. Also, the weight-average molecular weight of the amorphous resin (B) is preferably 6,000 or more, more preferably from 8,000 to 1,000,000, still more preferably from 8,000 to 100,000 and further still more preferably from 10,000 to 50,000 from the viewpoints of enhancing a heat-resistant storage property, a low-temperature fusing property and a durability of the resulting toner. Meanwhile, the number-average molecular weight and the weight-average molecular weight of the respective amorphous resins mean the values as measured with respect to a tetrahydrofuran soluble component therein.

In addition, the molecular weight distribution of the amorphous resin (B) is preferably 30 or less, more preferably 20 or less and still more preferably 10 or less, and more specifically is preferably from 1 to 30, more preferably from 1 to 20 and still more preferably from 1 to 10 from the viewpoints of enhancing a heat-resistant storage property, a low-temperature fusing property and a durability of the resulting toner. The molecular weight distribution means the value obtained by dividing the weight-average molecular weight by the number-average molecular weight.

The softening point of the amorphous resin (A) is 105° C. or lower. When controlling the softening point of the amorphous resin (A) to 105° C. or lower, it is possible to obtain a toner having a good low-temperature fusing property. The softening point of the amorphous resin (A) is preferably from 70 to 105° C., more preferably from 90 to 105° C. and still more preferably from 95 to 105° C. from the viewpoints of good low-temperature fusing property, heat-resistant storage property and durability of the resulting toner.

Also, the softening point of the amorphous resin (B) is preferably from 90 to 180° C., more preferably from 100 to 150° C. and still more preferably from 110 to 130° C. from the viewpoints of good low-temperature fusing property, heat-resistant storage property and durability of the resulting toner.

From the viewpoints of good low-temperature fusing property, heat-resistant storage property and durability of the resulting toner, the softening point of the amorphous resin (B) contained in the shell portion is preferably higher than the softening point of the amorphous resin (A) contained in the core portion, and the former softening point is more preferably higher by 1° C. or more, still more preferably higher by 3° C. or more, and further still more preferably higher by 5° C. or more, than the latter softening point. The upper limit of the difference between the softening points of the amorphous resins (A) and (B) is preferably 30° C. or less and more preferably 25° C. or less. Therefore, the value obtained by subtracting the softening point of the amorphous resin (A) from the softening point of the amorphous resin (B) is preferably from 1 to 30° C., more preferably from 3 to 25° C. and still more preferably from 5 to 25° C.

From the viewpoints of good low-temperature fusing property, heat-resistant storage property and durability of the resulting toner, the glass transition temperature (Tg) of the amorphous resin (A) is preferably from 33 to 65° C., more preferably from 35 to 60° C. and still more preferably from 37 to 55° C.

Also, from the viewpoints of good low-temperature fusing property, heat-resistant storage property and durability of the resulting toner, the glass transition temperature (Tg) of the amorphous resin (B) is preferably from 45 to 80° C., more preferably from 50 to 75° C. and still more preferably from 55 to 70° C.

The acid values of the amorphous resins (A) and (B) are each independently from 1 to 40 mg KOH/g, more preferably from 10 to 30 mg KOH/g and still more preferably from 15 to 25 mg KOH/g from the viewpoint of attaining a good dispersibility of the respective amorphous resins in the aqueous dispersion.

Meanwhile, the number-average molecular weight, softening point, Tg, and acid value of the respective amorphous resins may be readily controlled by suitably adjusting a composition of the raw material monomers used, a polymerization initiator, a molecular weight, an amount of a catalyst used, etc., or suitably selecting the reaction conditions.

From the viewpoint of enhancing a durability of the resulting toner, the amorphous resin (B) preferably contains components having a molecular weight of 1500 or less in an amount of 20% by mass or less, more preferably 15% by mass or less and still more preferably 12% by mass or less.

<Method for Producing Polyester-Based Resin>

The method for producing the polyester-based resin is not particularly limited. The polyester-based resin may be produced by any known methods in which an alcohol component and a carboxylic acid component are subjected to polycondensation reaction. The polycondensation reaction is preferably carried out in the presence of an esterification catalyst. From the viewpoints of well controlling a reactivity and a molecular weight as well as properties of the resulting resin, the polycondensation reaction is preferably carried out in the presence of both the esterification catalyst and a pyrogallol compound.

<Esterification Catalyst>

Examples of the esterification catalyst suitably used in the polycondensation reaction include titanium compounds and tin (II) compounds containing no Sn—C bond. These titanium compounds and tin compounds as the esterification catalyst may be used alone or in combination of any two or more thereof.

The titanium compound is preferably a titanium compound having a Ti—O bond and more preferably a titanium compound containing an alkoxy group, an alkenyloxy group or an acyloxy group having 1 to 28 carbon atoms in total.

Examples of the preferred tin (II) compound containing no Sn—C bond include tin (H) compounds having an Sn—O bond and tin (II) compounds having an Sn—X bond wherein X represents a halogen atom. Among these tin compounds, preferred are tin (II) compounds having an Sn—O bond. In particular, from the viewpoint of well controlling a reactivity and a molecular weight as well as properties of the resulting resin, more preferred is tin (II) dioctylate.

The amount of the esterification catalyst being present, in the reaction system is preferably from 0.01 to 1 part by mass and more preferably from 0.1 to 0.6 part by mass on the basis of 100 parts by mass of a total amount of the alcohol component and the carboxylic acid component from the viewpoints of well controlling a reactivity and a molecular weight as well as properties of the resulting resin.

<Pyrogallol Compound>

The pyrogallol compound is a compound containing a benzene ring in which three hydrogen atoms adjacent to each other are respectively substituted with a hydroxyl group. Examples of the pyrogallol compound include pyrogallol, gallic acid, gallic acid esters, benzophenone derivatives such as 2,3,4-trihydroxybenzophenone and 2,2',3,4-tetrahydroxybenzophenone, and catechin derivatives such as epigallocatechin and epigallocatechin gallate. Among these pyrogallol compounds, gallic acid is preferably used from the viewpoint of a good reactivity.

The amount of the pyrogallol compound being present in the polycondensation reaction system is preferably from 0.001 to 1 part by mass, more preferably from 0.005 to 0.4 part by mass and still more preferably from 0.01 to 0.2 part by mass on the basis of 100 parts by mass of a total amount of the alcohol component and the carboxylic acid component which are subjected to the polycondensation reaction, from the viewpoint of a good reactivity. The "amount of the pyrogallol compound being present" as used herein means a total amount of the pyrogallol compound compounded which is subjected to the polycondensation reaction.

The mass ratio of the pyrogallol compound to the esterification catalyst (pyrogallol compound/esterification catalyst) is preferably from 0.01 to 0.5, more preferably from 0.02 to 0.3 and still more preferably from 0.03 to 0.2 from the viewpoint of a good reactivity.

The polycondensation reaction between the alcohol component and the carboxylic acid component may be carried out, for example, in the presence of the above esterification catalyst in an inert gas atmosphere at a temperature of from 120 to 250° C. and preferably from 140 to 240° C.

In the polycondensation reaction, for example, in order to enhance a strength of the resulting resin, the whole raw material monomers may be added at one time. Alternatively, in order to reduce an amount of undesirable low-molecular weight components produced, there may be used the method in which the divalent monomers are first reacted, and then the trivalent or higher-valent monomers are added and reacted, etc. Further, the pressure in the reaction system may be reduced in a later stage of the polycondensation reaction to promote the reaction.

<Resin Binder for Toners>

The resin binder for toners used in the present invention is composed of the core-shell particles.

From the viewpoints of good low-temperature fusing property, heat-resistant storage property and charging stability of the resulting toner, the mass ratio of the amorphous resin (B) on the basis of 100 parts by mass of the whole resin binder containing the amorphous resin (A) is preferably from 10 to 120 parts by mass, more preferably from 20 to 100 parts by mass, still more preferably from 20 to 70 parts by mass and further still more preferably from 30 to 60 parts by mass.

Also, from the viewpoints of good low-temperature fusing property, heat-resistant storage property and durability of the resulting toner, the mass ratio of the amorphous resin (B) on the basis of 100 parts by mass of the amorphous resin (A) is preferably from 10 to 120 parts by mass, more preferably from 20 to 100 parts by mass, still more preferably from 20 to 70 parts by mass and further still more preferably from 30 to 60 parts by mass.

[Toner for Electrophotography]

In the toner for electrophotography according to the present invention which contains the above resin binder, any known resin binders for toners other than the above resin binder may also be contained in the core portion or the shell portion unless the aimed effects of the present invention are adversely affected. Examples of the other known resin binders include those resins such as polyesters, styrene-based resins such as styrene-acrylic resins, epoxy resins, polycarbonates and polyurethanes.

In the toner for electrophotography according to the present invention, the content of the resin binder for toners according to the present invention is preferably 50% by mass or more, more preferably 70% by mass or more, still more preferably 80% by mass or more, further still more preferably 90% by mass or more, and further still more preferably substantially 100% by mass on the basis of a total weight of the whole resin binder contained in the toner from the viewpoints of good lower-temperature fusing property, heat-resistant storage property and durability of the resulting toner.

[Process for Producing Toner for Electrophotography]

The toner for electrophotography according to the present invention can be produced by the process including the following steps 1 to 4:

Step 1: subjecting a resin aqueous dispersion containing the amorphous resin (A) having a softening point of 105° C. or lower which is obtained by polycondensing a carboxylic acid component containing an alkenyl succinic acid with an alcohol component to aggregation of the resin to prepare an aqueous dispersion of resin particles I;

Step 2: preparing a resin aqueous dispersion containing the amorphous resin (B) obtained by polycondensing an alcohol component containing an aliphatic diol having 2 to 6 carbon atoms with a carboxylic acid component;

Step 3: mixing the aqueous dispersion of the resin particles I obtained in the step 1 with the resin aqueous dispersion containing the amorphous resin (B) obtained in the step 2 to aggregate the resin particles I and the amorphous resin (B), thereby preparing an aqueous dispersion of resin particles II; and Step 4: coalescing the resin particles II obtained in the step 3.

According to the above process, it is possible to produce a toner for electrophotography which contains a resin binder in the form of core-shell particles in which a core portion of the respective core-shell particles contains the amorphous resin (A) and a shell portion thereof contains the amorphous resin (B).

<Step 1>

In the step 1, a resin aqueous dispersion containing the amorphous resin (A) having a softening point of 105° C. or lower which is obtained by polycondensing a carboxylic acid component containing an alkenyl succinic acid with an alcohol component is subjected to aggregation of the resin, if required, after mixing an aqueous dispersion of a releasing agent and/or an aqueous dispersion of a crystalline polyester therewith, to prepare an aqueous dispersion of resin particles I.

Meanwhile, the term "aqueous" as used herein means that it may also contain a solvent such as an organic solvent, but preferably contains water in an amount of 50% by mass or more, more preferably 70% by mass or more, still more preferably 90% by mass more and further still more preferably 99% by mass or more. Also, such a material as hereinafter referred to merely as the "resin" means both of the crystalline polyester and the amorphous resin.

(Preparation of Resin Aqueous Dispersion Containing Amorphous Resin (A))

[Preparation Using Organic Solvent]

The resin aqueous dispersion containing the amorphous resin (A) may be obtained by mixing the amorphous resin (A), an organic solvent and water, if required, together with a neutralizing agent or a surfactant, stirring the resulting mixture, and then removing the organic solvent from the obtained dispersion by distillation, etc. Preferably, the amorphous resin (A) is first dissolved, if required, together with the surfactant, in the organic solvent, and then the resulting organic solvent solution is mixed with water and, if required, the neutralizing agent. The mixture of the respective components may be stirred using an optional mixing and stirring apparatus such as an anchor blade.

Examples of the organic solvent include alcohol solvents such as ethanol, isopropanol and isobutanol; ketone solvents such as acetone, 2-butanone, methyl ethyl ketone, methyl isobutyl ketone and diethyl ketone; ether solvents such as dibutyl ether, tetrahydrofuran and dioxane; and ethyl acetate. Among these organic solvents, from the viewpoint of a good dispersibility of the resin binder therein, preferred are methyl ethyl ketone, ethyl acetate and 2-butanone, and more preferred is methyl ethyl ketone.

Examples of the neutralizing agent include hydroxides of alkali metals such as lithium hydroxide, sodium hydroxide and potassium hydroxide; and organic bases such as ammonia, trimethyl amine, ethyl amine, diethyl amine, triethyl amine, triethanol amine and tributyl amine. Among these neutralizing agents, from the viewpoints of good availability and workability, preferred is sodium hydroxide.

Examples of the surfactant include anionic surfactants such as sulfate-based surfactants, sulfonate-based surfactants, phosphate-based surfactants and soap-based surfactants (such as, e.g., alkyl ether carboxylic acid salts); cationic surfactants such as amine salt-type surfactants and quaternary ammonium salt-type surfactants; and nonionic surfactants, e.g., polyoxyethylene alkyl aryl ethers such as polyoxyethylene nonyl phenyl ether; polyoxyethylene alkyl ethers such as polyoxyethylene oleyl ether and polyoxyethylene lauryl ether; polyoxyethylene sorbitan esters such as polyoxyethylene sorbitan monolaurate and polyoxyethylene sorbitan monostearate; polyoxyethylene fatty acid esters such as polyethylene glycol monolaurate, polyethylene glycol monostearate and polyethylene glycol monooleate; and oxyethylene/oxypropylene block copolymers. The amount of the surfactant, if used, is preferably from 0.1 to 20 parts by mass and more preferably from 0.5 to 10 parts by mass on the basis of 100 parts by mass of the whole resin binder containing the amorphous resin (A) from the viewpoint of a good dispersibility of the resin binder.

The amount of the organic solvent to be mixed with the resin binder containing the amorphous resin (A) is preferably from 100 to 1000 parts by mass and more preferably from 150 to 500 parts by mass on the basis of 100 parts by mass of the whole resin binder containing the amorphous resin (A) from the viewpoint of a good solubility of the resin binder therein. The amount of water to be mixed with the resin binder containing the amorphous resin (A) is preferably from 100 to 1000 parts by mass and more preferably from 150 to 500 parts by mass on the basis of 100 parts by mass of the organic solvent from the viewpoint of a good solubility of the resin binder therein.

The temperature used upon mixing the amorphous resin (A) with the organic solvent is preferably from 30 to 90° C. and more preferably from 40 to 80° C. from the viewpoint of a good solubility of the resin binder in the organic solvent.

The solid content of the thus obtained aqueous dispersion containing the amorphous resin (A) may be controlled by adding an appropriate amount of water thereto, and is preferably controlled to the range of from 3 to 50% by mass, more preferably from 5 to 30% by mass and still more preferably from 7 to 15% by mass from the viewpoint of a good dispersibility of the resin binder therein.

[Volume Median Particle Size]

The volume median particle size of the resin binder particles containing the amorphous resin (A) in the aqueous dispersion is preferably from 50 to 1,000 nm, more preferably from 50 to 500 nm, still more preferably from 50 to 400 nm and further still more preferably from 100 to 350 nm from the viewpoint of uniformly aggregating the particles in the subsequent aggregating step. The volume median particle size may be measured by a laser diffraction type particle size measuring apparatus as described hereinlater, etc.

(Preparation of Resin Aqueous Dispersion Containing Crystalline Polyester)

The resin aqueous dispersion containing the crystalline polyester may also be produced by the same method as used for producing the above resin aqueous dispersion containing the amorphous resin (A), and the preferred ranges of the production conditions, etc., are also the same as those described for the above resin aqueous dispersion containing the amorphous resin (A).

(Preparation of Aqueous Dispersion of Resin Particles I (Aggregating Step))

Next, the resin aqueous dispersion containing the amorphous resin (A) is subjected to aggregation of the resin, if required, after mixing an aqueous dispersion of a releasing agent and/or the resin aqueous dispersion containing the crystalline polyester therewith, to prepare an aqueous dispersion of resin particles I.

Meanwhile, the above aggregating step may also be carried out after further adding various additives such as, for example, a colorant, a charge controlling agent, a conductivity modifier, an extender pigment, a reinforcing filler such as fibrous substances, an antioxidant and an anti-aging agent to the resin aqueous dispersion containing the amorphous resin (A). These additives may also be respectively used in the form of an aqueous dispersion thereof.

Further, in the aggregating step, in order to effectively carry out the aggregation, an aggregating agent may be added.

[Releasing Agent]

The amount of the releasing agent added is preferably from 0.1 to 10 parts by mass, more preferably from 0.5 to 10 parts by mass, still more preferably from 0.5 to 5 parts by mass and further still more preferably from 1 to 3 parts by mass on the basis of 100 parts by mass of a total amount of the resin binder containing the amorphous resin (A) in the core-forming resin particles from the viewpoint of a good dispersibility in the resin. The mass ratio between the releasing agent and the amorphous resin (A) in the core portion is the same as described above.

[Colorant]

The colorant used in the present invention is not particularly limited, and may be appropriately selected from known colorants according to the aimed applications or requirements. Specific examples of the colorant include various pigments such as carbon blacks, inorganic composite oxides, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Aniline Blue, ultramarine blue, Calco Oil Blue, Methylene Blue Chloride, Phthalocyanine Blue (copper phthalocyanine), Phthalocyanine Green and Malachite Green Oxalate; and various dyes such as acridine dyes, xanthene dyes, azo dyes, benzoquinone dyes, azine dyes, anthraquinone dyes, indigo dyes, thioindigo dyes, phthalocyanine dyes, Aniline Black dyes, polymethine dyes, triphenylmethane dyes, diphenylmethane dyes, thiazine dyes and thiazole dyes. These colorants may be used alone or in combination of any two or more thereof. The amount of the colorant added is preferably from 0.1 to 20 parts by mass, more preferably from 1 to 10 parts by mass and still more preferably from 5 to 10 parts by mass on the basis of 100 parts by mass of a total amount of the resin binder containing the amorphous resin (A) in the core-forming resin particles from the viewpoint of improving an image quality.

[Charge Controlling Agent]

Examples of the charge controlling agent include chromium-based azo dyes, iron-based azo dyes, aluminum-based azo dyes and metal complexes of salicylic acid. Among these charge controlling agents, preferred are metal complexes of salicylic acid from the viewpoints of a good charging stability of the resulting toner as well as a good availability thereof. These charge controlling agents may be used alone or in combination of any two or more thereof. The amount of the charge controlling agent added is preferably from 0.1 to 8 parts by mass, more preferably from 0.3 to 7 parts by mass and still more preferably from 0.8 to 3 parts by mass on the basis of 100 parts by mass of a total amount of the resin binder containing the amorphous resin (A) in the core-forming resin particles from the viewpoint of improving an image quality.

[Aggregating Agent]

As the organic aggregating agent, a cationic surfactant in the form of a quaternary ammonium salt, polyethyleneimine or the like may be used, and as the inorganic aggregating agent, an inorganic metal salt, an inorganic ammonium salt, a divalent or higher-valent metal complex or the like may be used.

Specific examples of the inorganic metal salt include metal salts such as sodium sulfate, sodium chloride, calcium chloride, calcium nitrate, barium chloride, magnesium chloride, zinc chloride, aluminum chloride and aluminum sulfate; and inorganic metal salt polymers such as poly(aluminum chloride), poly(aluminum hydroxide) and poly(calcium sulfide). Specific examples of the inorganic ammonium salt include ammonium sulfate, ammonium chloride and ammonium nitrate.

The amount of the aggregating agent added is preferably 60 parts by mass or less, more preferably 30 parts by mass or less and still more preferably 10 parts by mass or less on the basis of 100 parts by mass of the resin binder in view of a good environmental resistance of the resulting toner.

The aggregating agent is preferably added in the form of an aqueous solution prepared by dissolving the aggregating agent in an aqueous medium to allow a uniform aggregation of the respective particles, and the mixture obtained during and after addition of the aggregating agent is preferably sufficiently stirred.

[Several Conditions in Reaction System]

The solid content in the reaction system used in the aggregating step is preferably from 5 to 50% by mass, more preferably from 5 to 30% by mass and still more preferably from 5 to 20% by mass in view of uniformly aggregating the particles.

The pH value of the reaction system used in the aggregating step is preferably from 2 to 10, more preferably from 2 to 9 and still more preferably from 3 to 8 from the viewpoints of achieving both of a good dispersion stability of the mixed solution and a good aggregating property of the resin particles.

From the same viewpoints as described above, the temperature of the reaction system in the aggregating step is preferably not lower than the temperature calculated from the "softening point of the resin binder in the core portion−(minus) 75° C." (this means the temperature lower by 75° C. than the softening point of the resin binder in the core portion; hereinafter defined in the same way) and not higher than the softening point of the resin binder in the core portion. In the present invention, since the amorphous resin (A) is used as the resin binder in the core portion, the "softening point of the resin binder in the core portion" is identical to the softening point of the amorphous resin (A). Also, in the case where the amorphous resin (A) is used in combination with the crystalline polyester or the amorphous resin other than the amorphous resin (A) as the resin binder, the "softening point of the resin binder in the core portion" is defined as a weighted mean value of softening points of the amorphous resin (A) and the crystalline polyester or the amorphous resin other than the amorphous resin (A). In addition, when using a master batch, the "softening point of the resin binder in the core portion" is also determined from a weighted mean value of softening points of those resins in the form of a mixed resin including resins used for forming the master batch.

In addition, the additives such as a colorant and a charge controlling agent may be previously mixed in the resin binder containing the amorphous resin (A) upon preparing the resin particles. Alternatively, the respective additives may be separately dispersed in a dispersing medium such as water to prepare respective dispersions, and the thus prepared additive dispersions may be mixed with the resin binder particles containing the amorphous resin (A) or the other resin particles and then subjected to the aggregating step. When the additives are previously mixed in the resin binder containing the amorphous resin (A) upon preparing the resin particles, the resin binder containing the amorphous resin (A) and the additives are preferably previously melt-kneaded with each other.

The melt-kneading is preferably carried out using an open roll type twin-screw kneader. The open roll type twin-screw kneader has two rolls arranged close to and parallel with each other through which a heating medium can be flowed to impart a heating function or a cooling function thereto. Thus, since the open roll type twin-screw kneader has a melt-kneading section having an open structure and is equipped with a heating roll and a cooling roll, a kneading heat generated upon the melt-kneading can be readily released therefrom unlike the conventional twin-screw extruders.

[Dispersing Treatment]

The mixture containing an aqueous dispersion containing the resin binder containing the amorphous resin (A), if required, together with a resin aqueous dispersion containing the crystalline polyester or the amorphous resin other than the amorphous resin (A) and an aqueous dispersion containing various additives is preferably subjected to dispersing treatment at a temperature lower than the softening point of the resin binder in the core portion and more preferably at a temperature not higher than the "softening point of the resin binder in the core portion−(minus) 30° C." from the viewpoint of obtaining a uniform dispersion. More specifically, the temperature used upon the dispersing treatment is preferably 70° C. or lower and more preferably 65° C. or lower. Also, the dispersing treatment is preferably carried out at a temperature higher than 0° C., and more preferably at a temperature of 10° C. or higher from the viewpoints of maintaining a good fluidity of the medium and saving an energy required for production of the aqueous dispersion of the respective resins.

From these viewpoints, the above mixture may be dispersed by an ordinary method such as dispersing treatment with stirring at a temperature of preferably from about 0 to about 70° C. and more preferably from about 10 to about 65° C., thereby enabling preparation of a uniform resin dispersion.

The dispersing treatment may be carried out using a high-speed mixer or stirrer such as "Ultra Disper" (tradename: available from Asada Iron Works Co., Ltd.), "Ebara Milder" (tradename: available from Ebara Corp.) and "TK Homo Mixer" (tradename: available from Primix Corp.); a homo-valve-type high-pressure homogenizer such as typically "High-Pressure Homogenizer" (tradename: available from Izumi Food Machinery Co., Ltd.) and "Mini-Labo 8.3H Model" (tradename: available from Rannie Corp.); and a chamber-type high-pressure homogenizer such as "Microfluidizer" (tradename: available from Microfluidics Inc.) and "Nanomizer" (tradename: available from Nanomizer Inc.).

[Volume Median Particle Size of Resin Particles I]

The volume median particle size of the resin particles I obtained in the step 1 is preferably from 1 to 10 μm, more preferably from 2 to 8 μm and still more preferably from 3 to 7 μm from the viewpoint of uniformly coalescing the aggregated particles in the subsequent step 4 to produce toner particles.

<Step 2>

In the step 2, a resin aqueous dispersion containing the amorphous resin (B) is prepared. The method for preparing the aqueous dispersion and the preferred properties thereof are also the same as described above in the step 1.

<Step 3>

In the step 3, the aqueous dispersion of the core-forming resin particles I obtained by subjecting the aqueous dispersion of the resin binder containing the amorphous resin (A) to aggregation of the resin binder in the step 1 is mixed with the resin aqueous dispersion containing the amorphous resin (B) obtained in the step 2 to aggregate the resin particles I and the amorphous resin (B), thereby preparing an aqueous dispersion of resin particles II.

The volume median particle size of the particles contained in the aqueous dispersion containing the amorphous resin (B) which is to be mixed in the step 3 is preferably from 50 to 1,000 nm, more preferably from 50 to 500 nm, still more preferably from 50 to 400 nm and further still more preferably from 100 to 350 nm from the viewpoint of producing uniform core-shell particles.

The amount of the amorphous resin (B) to be mixed is preferably from 5 to 200 parts by mass, more preferably from 10 to 100 parts by mass and still more preferably from 25 to 60 parts by mass on the basis of 100 parts by mass of the resin particles I obtained in the step 1.

The mass ratio between the amorphous resin (A) and the amorphous resin (B) in the resin particles II obtained in the step 3 may be the same as the mass ratio between the amorphous resin (A) and the amorphous resin (B) as described above.

The average particle size of the resin particles II obtained in the step 3 is controlled such that the volume median particle size thereof is preferably from 1 to 10 μm, more preferably from 2 to 8 μm and still more preferably from 3 to 7 μm from the viewpoint of uniformly coalescing the resin particles in the subsequent step 4 to produce toner particles. The aggregating conditions are the same as described in the step 1.

<Step 4>

In the step 4, the aqueous dispersion of the resin particles II obtained in the step 3 is subjected to a coalescing step, if required, after adding an aggregation stopping agent thereto, to coalesce the resin particles II in the aqueous dispersion, thereby obtaining an aqueous dispersion of unified particles.

In the step 4, the aggregated particles obtained in the step 3 are heated to obtain unified particles thereof.

The temperature of the reaction system in the step 4 is preferably not lower than the "softening point of the resin binder−(minus) 50° C." and not higher than the "softening point of the resin binder+(plus) 10° C."; more preferably not lower than the "softening point of the resin binder−(minus) 45° C." and not higher than the "softening point of the resin binder+(plus) 10° C."; and still more preferably not lower than the "softening point of the resin binder−(minus) 40° C." and not higher than the "softening point of the resin binder+(plus) 10° C.", from the viewpoints of well controlling a particle size, a particle size distribution and a particle shape of the toner as aimed, and attaining a good fusibility of the particles. More specifically, from the same viewpoints, the temperature of the reaction system in the step 4 is preferably kept in the range of from 40 to 90° C. and more preferably from 50 to 80° C. In addition, the stirring rate used in the step 4 is preferably a rate at which the aggregated particles are not precipitated. The "softening point of the resin binder" as used herein means the temperature as a weighted mean value of the softening point of the amorphous resin (A) and the softening point of the amorphous resin (B). When further using the crystalline polyester or the amorphous resin other than the amorphous resins (A) and (B), the "softening point of the resin binder" as used herein means the temperature as a weighted mean value of the softening points of the amorphous resin (A) and the amorphous resin (B) and the softening point of the crystalline polyester or the amorphous resin other than the amorphous resins (A) and (B).

Meanwhile, as the aggregation stopping agent which may be added in the step 4, a surfactant is preferably used. The aggregation stopping agent is more preferably an anionic surfactant from the viewpoints of good availability and handling property. Among the anionic surfactants, at least one compound selected from the group consisting of alkylether sulfuric acid salts, alkyl sulfuric acid salts and straight-chain alkylbenzenesulfonic acid salts is still more preferably used.

[Toner for Electrophotography]

The toner for electrophotography according to the present invention (hereinafter referred to merely as a "toner") may be produced by appropriately subjecting the unified particles obtained in the step 4 to a liquid-solid separation step such as filtration, a washing step and a drying step.

In the washing step, the unified particles may be washed with an acid to remove metal ions from the surface of the respective toner particles for the purpose of ensuring sufficient charging characteristics and a good reliability required for the resulting toner. In the washing step, the unified particles are preferably washed to such an extent that the nonionic surfactant added is also completely removed therefrom. In addition, the unified particles are preferably washed with an aqueous solution at a temperature not higher than a cloud point of the nonionic surfactant. The washing procedure is preferably repeated a plurality of times.

In addition, in the drying step, any optional methods such as vibration-type fluidization drying method, spray-drying method, freeze-drying method and flash jet method may be employed. The content of water in the toner obtained after drying is preferably adjusted to 1.5% by mass or less and more preferably 1.0% by mass or less from the viewpoint of a good charging property of the resulting toner.

Further, for the purpose of improving a fluidity, etc., an external additive may be added to the thus obtained toner. As the external additive, there may be used known fine particles. Examples of the fine particles as the external additive include inorganic fine particles such as silica fine particles whose surface is subjected to a hydrophobic treatment, titanium oxide fine particles, alumina fine particles, cerium oxide fine particles and carbon blacks; and polymer fine particles such as fine particles of polycarbonates, polymethyl methacrylate, silicone resins, etc.

The number-average particle size of the external additive is preferably from 4 to 200 nm and more preferably from 8 to 30 nm from the viewpoint of a good fluidity of the resulting toner. The number-average particle size of the external additive may be determined using a scanning electron microscope or a transmission electron microscope.

The amount of the external additive added to the toner is preferably from 0.1 to 5 parts by mass, more preferably from 0.1 to 1 part by mass and still more preferably from 0.2 to 0.8 part by mass on the basis of 100 parts by mass of the toner before being treated with the external additive from the viewpoints of a good fluidity, a good environmental stability of charging rate and a good storage stability.

(Properties of Toner for Electrophotography)

The volume median particle size of the toner for electrophotography according to the present invention is preferably from 1 to 10 μm, more preferably from 2 to 8 μm and still more preferably from 3 to 7 μm from the viewpoints of a high image quality and a high productivity of the toner.

The softening point of the toner is preferably from 80 to 160° C., more preferably from 80 to 150° C. and still more preferably from 90 to 140° C. from the viewpoints of good low-temperature fusing property, heat-resistant storage property and durability of the resulting toner.

The toner for electrophotography according to the present invention may be used in the form of a one-component system developer or a tow-component system developer formed by mixing the toner with a carrier.

EXAMPLES

Various properties of the resins, etc., were measured by the following methods.

<Softening Point of Resin>

Using a flow tester (tradename: "CFT-500D" available from Shimadzu Corp.), 1 g of a sample was extruded through a nozzle having a die pore size of 1 mm and a length of 1 mm while heating the sample at a temperature rise rate of 6° C./min and applying a load of 1.96 MPa thereto with a plunger of the flow tester. The softening point of the sample was determined as the temperature at which a half amount of the sample was flowed out when plotting a downward movement of the plunger of the flow tester relative to temperature.

<Endothermic Highest Peak Temperature and Melting Point of Resin>

Using a differential scanning calorimeter (tradename: "Q-100" available from T.A. Instruments, Japan, Inc.), a sample was cooled from room temperature (20° C.) to 0° C. at a temperature drop rate of 10° C./min, allowed to stand as such at 0° C. for 1 min, and then heated up to 180° C. at a temperature rise rate of 10° C./min to measure an endothermic curve thereof. The temperature of the peak present on the highest temperature side among the endothermic peaks observed in the curve was determined as the endothermic highest peak temperature. If the difference between the highest peak temperature and the softening point was within 20° C., the highest peak temperature was determined as a melting point of the crystalline polyester.

<Glass Transition Temperature of Amorphous Resin>

Using a differential scanning calorimeter (tradename: "Q-100" available from T.A. Instruments, Japan, Inc.), a sample was weighed in an amount of from 0.01 to 0.02 g on an aluminum pan, heated to 200° C., cooled from 200° C. to 0° C. at a temperature drop rate of 10° C./min, and then heated again to 150° C. at a temperature rise rate of 10° C./min to measure an endothermic curve thereof. The glass transition temperature of the sample was determined from the endothermic curve by reading out the temperature at which an elongation of a base line below the endothermic highest peak temperature intersects a tangential line having a maximum inclination in a region from a raise-up portion to an apex of the peak in the curve.

<Acid Value of Resin>

The acid value of the resin was determined by the method according to JIS K 0070. However, only with respect to the solvent for the measurement, the mixed solvent of ethanol and ether as prescribed in JIS K 0070 was replaced with a mixed solvent containing acetone and toluene at a volume ratio of 1:1.

<Volume Median Particle Sizes ($D_{50}$) of Resin Particles, Colorant Fine Particles, Releasing Agent Fine Particles and Charge Controlling Agent Fine Particles>

Using a laser diffraction particle size analyzer (tradename: "LA-920" commercially available from Horiba, Ltd.), a cell for the measurement was filled with distilled water, and a volume median particle size ($D_{50}$) of the particles was measured at a concentration at which an absorbance thereof was within an adequate range.

<Number-Average Molecular Weight and Weight-Average Molecular Weight of Polyester>

The number-average molecular weight (Mn) and the weight-average molecular weight (Mw) of the resin were calculated from the molecular weight distribution measured by gel permeation chromatography (GPC) according to the following method.

(1) Preparation of Sample Solution

The resin was dissolved in chloroform to prepare a solution having a concentration of 0.5 g/100 mL. The resultant solution was then filtered through a fluororesin filter (tradename: "FP-200" commercially available from Sumitomo Electric Industries, Ltd.) having a pore size of 2 μm to remove insoluble components therefrom, thereby preparing a sample solution.

(2) Measurement of Molecular Weight Distribution

Using the below-mentioned apparatus, chloroform as an eluent was allowed to flow through a column at a flow rate of 1 mL/min, and the column was stabilized in a thermostat at 40° C. One hundred microliters of the sample solution were injected into the column to measure a molecular weight distribution of the sample. The molecular weight of the sample was calculated on the basis of a calibration curve previously prepared. The calibration curve of the molecular weight was prepared by using several kinds of monodisperse polystyrenes (those monodisperse polystyrenes having number-average molecular weights of $2.63\times10^3$, $2.06\times10^4$ and $1.02\times10^5$ available from Tosoh Corporation; and those monodisperse polystyrenes having number-average molecular weights of $2.10\times10^3$, $7.00\times10^3$ and $5.04\times10^4$ available from GL Sciences, Inc.) as standard samples.

Analyzer: "CO-8010" (tradename: commercially available from Tosoh Corp.)

Column: "$GMH_{XL}$"+"$G3000H_{XL}$" (tradenames both commercially available from Tosoh Corp.)

<Components Having Molecular Weight of 1500 or Less in Polyester>

According to the following method, a content (mass %) of the components having a molecular weight of 1500 or less was determined by gel permeation chromatography (GPC).

(1) Preparation and Measurement of Sample Solution

The preparation and measurement of the sample solution were carried out by the same method as described above in "Number-Average Molecular Weight and Weight-Average Molecular Weight of Polyester".

(2) Calculation Method

The peaks in the chart prepared by the above method were split into two parts by a straight line at a retention time value at which a reduced molecular weight based on a calibration curve prepared from the above standard substances was 1500. The area of the peaks on the smaller molecular weight side was divided by a total area of the whole peaks to calculate a content (mass %) of the components having a molecular weight of 1500 or less.

Production Example 1

Production of Alkylene Compound A

A propylene tetramer (tradename "Light Tetramer" available from Nippon Oil Corp.) was subjected to fractional distillation under heating at a temperature of from 183 to 208° C. to obtain an alkylene compound A. As a result of subjecting the thus obtained alkylene compound A to the below-mentioned gas chromatography-mass spectrometry, it was confirmed that 40 peaks were observed in a characteristic curve thereof. The results of distribution analysis of the alkylene compound A are as follows: $C_9H_{18}$: 0.5% by mass; $C_{10}H_{20}$: 4% by mass; $C_{11}H_{22}$: 20% by mass; $C_{12}H_{24}$: 66% by mass; $C_{13}H_{26}$: 9% by mass; $C_{14}H_{28}$: 0.5% by mass.

[Analysis of Alkylene Compound A by Gas Chromatography-Mass Spectrometry]

A gas chromatograph mass spectrometer (GUMS) was equipped with a CI ion source and the following analyzing column, and subjected to start-up operation. Meanwhile, the analyzer was tuned after the elapse of 24 h from initiation of evacuation work of a MS section while flowing a CI reaction gas (methane) therethrough.

(1) GC

Gas chromatograph: "HP6890N" (tradename) available from Agilent Technologies, Inc.

Column: "Ultra 1" (tradename; column length: 50 m; inner diameter: 0.2 mm; membrane thickness: 0.33 μm) available from HP Co.

GC oven heating conditions:

Initial temperature: 100° C. (0 min)

First stage temperature rise rate: 1° C./min (up to 150° C.)

Second stage temperature rise rate: 10° C./min (up to 300° C.)

Final temperature: 300° C. (10 min)

Amount of Sample Injected: 1 μL

Injection port conditions:

Injection mode: Split method

Split ratio: 50:1

Injection port temperature: 300° C.

Carrier gas:

Gas: Helium

Flow rate: 1 mL/min (constant flow rate mode)

(2) Detector

Mass spectrometer: "5973N MSD" (tradename) available from Agilent Technologies Inc.

Ionization method: Chemical ionization method

Reaction gas: Isobutane

Temperatures set:

Quadrupole: 150° C.

Ion source: 250° C.

Detection conditions: scanning

Scanning range: m/z 75 to 300

ON time of detector: 5 min

Calibration (mass calibration and sensitivity adjustment):

Reaction gas: Methane

Calibrant: PFDTD (perfluoro-5,8-dimethyl-3,6,9-trioxydodecane)

Tuning method: Auto-tuning (3) Preparation of Sample

A propylene tetramer was dissolved in isopropyl alcohol to prepare a sample solution having a propylene tetramer concentration of 5% by mass.

(Data Processing Method)

Respective alkene components having 9 to 14 carbon atoms were subjected to extraction of mass chromatograms based on mass numbers corresponding to the respective molecular ions. The extracted mass chromatograms were integrated under the integration conditions for each component as shown in Tables 2 to 5 and under the condition of S/N (signal/noise ratio)>3. From the detection results as shown in Table 1, the proportion of specific alkyl chain length components is calculated according to the following formula.

Proportion of specific alkyl chain length components (%)= (Sum of integrated values of specific alkyl chain length components)/(Sum of integrated values of alkenes having 9 to 14 carbon atoms)×100

TABLE 1

| | Molecular weight (Mw) | Molecular ion (M/Z) | Monitor mass range (M/Z-M/Z) |
|---|---|---|---|
| $C_9H_{18}$ | 126 | 127 | 126.70-127.70 |
| $C_{10}H_{20}$ | 140 | 141 | 140.70-141.70 |
| $C_{11}H_{22}$ | 154 | 155 | 154.70-155.70 |
| $C_{12}H_{24}$ | 168 | 169 | 168.70-169.70 |
| $C_{13}H_{26}$ | 182 | 183 | 182.70-183.70 |
| $C_{14}H_{28}$ | 196 | 197 | 196.70-197.70 |

(4) Integration Conditions

Component: $C_9H_{18}$

TABLE 2

| Integration conditions | Values (V) | Time (T) |
|---|---|---|
| Initial Area Reject | 0 | Initial |
| Initial Peak Width | 0.200 | Initial |
| Shoulder Detection | OFF | Initial |
| Initial Threshold | 5.0 | Initial |
| Peak Width | 2.000 | 5.000 |

Component: $C_{10}H_{22}$

TABLE 3

| Integration conditions | Values (V) | Time (T) |
|---|---|---|
| Initial Area Reject | 0 | Initial |
| Initial Peak Width | 0.200 | Initial |
| Shoulder Detection | OFF | Initial |
| Initial Threshold | 7.0 | Initial |
| Peak Width | 2.000 | 5.000 |

Components: $C_{11}H_{22}$, $C_{12}H_{24}$ and $C_{13}H_{26}$

TABLE 4

| Integration conditions | Values (V) | Time (T) |
|---|---|---|
| Initial Area Reject | 0 | Initial |
| Initial Peak Width | 0.200 | Initial |
| Shoulder Detection | OFF | Initial |
| Initial Threshold | 7.0 | Initial |
| Peak Width | 2.000 | 5.000 |

Components: $C_{14}H_{28}$

TABLE 5

| Integration conditions | Values (V) | Time (T) |
|---|---|---|
| Initial Area Reject | 0 | Initial |
| Initial Peak Width | 0.200 | Initial |
| Shoulder Detection | OFF | Initial |
| Initial Threshold | 5.0 | Initial |
| Peak Width | 2.000 | 11.000 |

In the present invention, the alkylene compounds having 9 to 14 carbon atoms mean those compounds having peaks corresponding to respective molecular ions as measured by gas chromatography/mass spectrometry.

Production Example 2

Production of Alkenyl Succinic Anhydride A

A 1 L autoclave available from Nitto Koatsu Co., Ltd., was charged with 542.4 g of the alkylene compound A, 157.2 g of maleic anhydride, 0.4 g of an antioxidant "Chelex-0" (tri-isooctyl phosphite; available from SC Organic Chemical Co., Ltd.) and 0.1 g of butyl hydroquinone as a polymerization inhibitor, and an interior of the autoclave was replaced with pressurized nitrogen (0.2 MPaG) three times. After stirring was initiated at 60° C., the contents of the autoclave were heated up to 230° C. over 1 h, and then reacted with each other at 230° C. for 6 h. The pressure upon reaching the reaction temperature was 0.3 MPaG. After completion of the reaction, the resulting reaction solution was cooled to 80° C., and after the pressure of the reaction system was returned to normal pressures (101.3 kPa), the reaction solution was transferred into a 1 L four-necked flask. The reaction solution in the flask was heated to 180° C. while stirring, and the residual alkylene compound was distilled off therefrom under a pressure of 1.3 kPa over 1 h. Successively, the reaction solution was cooled to room temperature (25° C.), and then the pressure within the flask was returned to normal pressures (101.3 kPa), thereby obtaining 406.1 g of an alkenyl succinic anhydride A as the aimed product. The average molecular weight of the alkenyl succinic anhydride A as calculated from an acid value thereof was 268.

Production Examples 3, 4, 6, 7, 11, 14 to 18, 20 and 22

Production of Amorphous Resins A1, A2, A4, A5, A9, B2 to B6, B8 and B10

The polyester raw material monomers except for trimellitic anhydride, tin (II) dioctylate and gallic acid as shown in Tables 6 and 7 were charged into a 5 L four-necked flask equipped with a nitrogen inlet tube, a dehydration tube having a fractional distillation tube through which a hot water at 100° C. was flowed, a stirrer and a thermocouple. In a nitrogen atmosphere, the contents of the flask were held at 180° C. for 1 h and then heated from 180° C. to 230° C. at a temperature rise rate of 10° C./h, and thereafter subjected to polycondensation reaction at 230° C. for 10 h, followed by further conducting the reaction at 230° C. under a pressure of 8.0 kPa for 1 h. Further, the resulting reaction mixture was reacted with trimellitic anhydride at 210° C., and the reaction was continued under a pressure of 10 kPa until reaching the softening point shown in Tables, thereby obtaining amorphous resins A1, A2, A4, A5, A9, B2 to B6, B8 and B10.

Production Example 12

Production of Resin c1

Crystalline Polyester

The polyester raw material monomers and tert-butyl catechol as a polymerization inhibitor as shown in Table 6 were charged into a 5 L four-necked flask equipped with a nitrogen inlet tube, a dehydration tube, a stirrer and a thermocouple. The contents of the flask were reacted at 140° C. over 5 h and then further reacted while heating to 200° C. at a temperature rise rate of 10° C./h. The reaction was continued at 200° C. until reaching a reaction rate of 80%. Thereafter, tin (II) dioctylate as shown in Table 6 was added to the obtained reaction solution, and the resulting mixture was reacted at 200° C. for 2 h and further reacted under a pressure of 8 kPa for 2 h, thereby obtaining a resin c1 (crystalline polyester).

Production Examples 8 to 10 and 21

Production of Amorphous Resins A6 to A8 and B9

The polyester raw material monomers except for trimellitic anhydride, tin (II) dioctylate and gallic acid as shown in Tables 6 and 7 were charged into a 5 L four-necked flask equipped with a nitrogen inlet tube, a dehydration tube, a stirrer and a thermocouple. The contents of the flask were subjected to polycondensation reaction at 230° C. over 10 h in a nitrogen atmosphere, and then reacted at 230° C. under a pressure of 8.0 kPa for 1 h. Further, the resulting reaction mixture was reacted with trimellitic anhydride at 210° C., and the reaction was continued under a pressure of 10 kPa until reaching the softening point shown in Tables, thereby obtaining amorphous resins A6 to A8 and B9.

Production Examples 5, 13 and 19

Production of Amorphous Resins A3, B1 and B7

The polyester raw material monomers except for trimellitic anhydride and fumaric acid, tin (II) dioctylate and gallic acid as shown in Tables 6 and 7 were charged into a 5 L four-necked flask equipped with a nitrogen inlet tube, a dehydration tube having a fractional distillation tube through which a hot water at 100° C. was flowed, a stirrer and a thermocouple. In a nitrogen atmosphere, the contents of the flask were held at 180° C. for 1 h and then heated from 180° C. to 230° C. at a temperature rise rate of 10° C./h, and thereafter subjected to polycondensation reaction at 230° C. for 10 h, followed by further conducting the reaction at 230° C. under a pressure of 8.0 kPa for 1 h. The resulting reaction mixture was cooled to 180° C., and then trimellitic anhydride, fumaric acid and tert-butyl catechol as a polymerization inhibitor were added thereto. The obtained reaction mixture was heated from 180 to 210° C. at a temperature rise rate of 10° C./h and reacted at 210° C. for 1 h, and further the reaction as shown in Tables was conducted at 210° C. under a pressure of 10 kPa, thereby obtaining amorphous resins A3, B1 and B7.

TABLE 6

| | Core Production Example | | | | | | | | | |
|---|---|---|---|---|---|---|---|---|---|---|
| | 3 | | 4 | | 5 | | 6 | | 7 | |
| | Resin | | | | | | | | | |
| | A1 | | A2 | | A3 | | A4 | | A5 | |
| Raw material monomers | Amount charged (g) | Molar ratio 1) | Amount charged (g) | Molar ratio 1) | Amount charged (g) | Molar ratio 1) | Amount charged (g) | Molar ratio 1) | Amount charged (g) | Molar ratio 1) |
| (Alcohol component) | | | | | | | | | | |
| 2,3-Butanediol | | | 900 | 50 | | | | | | |
| 1,2-Propanediol | 1520 | 100 | 760 | 50 | 1520 | 100 | | | | |
| Neopentyl glycol | | | | | | | 1040 | 50 | 1560 | 100 |
| Ethylene glycol | | | | | | | 620 | 50 | | |
| 1,6-Hexanediol | | | | | | | | | | |
| Bisphenol A-PO adduct | | | | | | | | | | |
| Bisphenol A-EO adduct | | | | | | | | | | |
| (Acid component) | | | | | | | | | | |
| Fumaric acid | | | | | 232 | 10 | | | | |
| Alkenyl succinic anhydride | 2144 | 40 | 1340 | 25 | 2144 | 40 | 1608 | 30 | 1608 | 40 |
| Terephthalic acid | 1494 | 45 | 1992 | 60 | 1328 | 40 | 1992 | 60 | 1121 | 45 |
| Isophthalic acid | | | | | | | | | | |
| Trimellitic anhydride | 576 | 15 | 576 | 15 | 230 | 6 | 384 | 10 | 432 | 15 |
| (Catalyst, etc.) | | | | | | | | | | |
| Tin (II) dioctylate | 28.7 | 0.5 | 23.3 | 0.5 | 27.3 | 0.5 | 28.2 | 0.5 | 23.6 | 0.5 |
| Gallic acid | 2.9 | 0.05 | 2.3 | 0.05 | 2.7 | 0.05 | 2.8 | 0.05 | 2.4 | 0.05 |
| Tert-butyl catechol | | | | | 2.7 | 0.05 | | | | |
| Properties | | | | | | | | | | |
| Acid value (mg KOH/g) | 23.6 | | 21.5 | | 24.2 | | 19.5 | | 20.6 | |
| Softening point (° C.) | 104.2 | | 103.9 | | 102.1 | | 104.3 | | 102.5 | |
| Glass transition point (° C.) | 40.5 | | 49.2 | | 37.1 | | 43.5 | | 38.9 | |
| Melting point, endothermic highest peak temperature (° C.) | 41.5 | | 51.9 | | 39.8 | | 46.1 | | 39.7 | |
| Number-average molecular weight | 3000 | | 2700 | | 3100 | | 2900 | | 2800 | |
| Weight-average molecular weight | 20000 | | 18000 | | 23000 | | 30000 | | 19000 | |

| | Core Production Example | | | | | | | | | |
|---|---|---|---|---|---|---|---|---|---|---|
| | 8 | | 9 | | 10 | | 11 | | 12 | |
| | Resin | | | | | | | | | |
| | A6 | | A7 | | A8 | | A9 | | c1 | |
| Raw material monomers | Amount charged (g) | Molar ratio 1) | Amount charged (g) | Molar ratio 1) | Amount charged (g) | Molar ratio 1) | Amount charged (g) | Molar ratio 1) | Amount charged (g) | Molar ratio 1) |
| (Alcohol component) | | | | | | | | | | |
| 2,3-Butanediol | | | | | | | | | | |
| 1,2-Propanediol | | | | | | | 1520 | 100 | | |
| Neopentyl glycol | | | | | | | | | | |
| Ethylene glycol | | | | | | | | | | |
| 1,6-Hexanediol | | | | | | | | | 2360 | 100 |
| Bisphenol A-PO adduct | 2450 | 70 | 2450 | 70 | 2450 | 70 | | | | |
| Bisphenol A-EO adduct | 975 | 30 | 975 | 30 | 975 | 30 | | | | |

TABLE 6-continued

| | | | | | | | | | | |
|---|---|---|---|---|---|---|---|---|---|---|
| (Acid component) | | | | | | | | | | |
| Fumaric acid | | | | | | | | | 2320 | 100 |
| Alkenyl succinic anhydride | 402 | 15 | 1072 | 40 | | | 2144 | 40 | | |
| Terephthalic acid | | | 664 | 40 | 1162 | 70 | | | | |
| Isophthalic acid | 1079 | 65 | | | | | 1494 | 45 | | |
| Trimellitic anhydride | 192 | 10 | 192 | 10 | 288 | 15 | 576 | 15 | | |
| (Catalyst, etc.) | | | | | | | | | | |
| Tin (II) dioctylate | 25.5 | 0.5 | 26.8 | 0.5 | 24.4 | 0.5 | 28.7 | 0.5 | 23.4 | 0.5 |
| Gallic acid | 2.5 | 0.05 | 2.7 | 0.05 | 2.4 | 0.05 | 2.9 | 0.05 | | |
| Tert-butyl catechol | | | | | | | | | 2.3 | 0.05 |
| Properties | | | | | | | | | | |
| Acid value (mg KOH/g) | 24.8 | | 26.3 | | 27.1 | | 24.5 | | 21.3 | |
| Softening point (° C.) | 100.1 | | 99.4 | | 110.4 | | 103.4 | | 113.1 | |
| Glass transition point (° C.) | 53.5 | | 46.3 | | 63.2 | | 39.1 | | — | |
| Melting point, endothermic highest peak temperature (° C.) | 57.1 | | 49.6 | | 68.5 | | 40.1 | | 110.3 | |
| Number-average molecular weight | 2900 | | 2900 | | 3000 | | 3000 | | 3600 | |
| Weight-average molecular weight | 9000 | | 13000 | | 10000 | | 21000 | | 8000 | |

Note

[1] The values of molar ratios of tin (II) dioctylate, gallic acid and tert-butyl catechol were respectively "part(s) by mass" on the basis of 100 parts by mass of a total amount of an alcohol component and a carboxylic acid component to be subjected to polycondensation reaction.

TABLE 7

| | Shell Production Example | | | | | | | | | |
|---|---|---|---|---|---|---|---|---|---|---|
| | 13 | | 14 | | 15 | | 16 | | 17 | |
| | Resin | | | | | | | | | |
| | B1 | | B2 | | B3 | | B4 | | B5 | |
| Raw material monomers | Amount charged (g) | Molar ratio [1] | Amount charged (g) | Molar ratio [1] | Amount charged (g) | Molar ratio [1] | Amount charged (g) | Molar ratio [1] | Amount charged (g) | Molar ratio [1] |
| (Alcohol component) | | | | | | | | | | |
| 2,3-Butanediol | | | | | | | | | | |
| 1,2-Propanediol | 1520 | 100 | 1520 | 100 | 1520 | 100 | 1520 | 100 | 1520 | 100 |
| Neopentyl glycol | | | | | | | | | | |
| Ethylene glycol | | | | | | | | | | |
| 1,6-Hexanediol | | | | | | | | | | |
| Bisphenol A-PO adduct | | | | | | | | | | |
| Bisphenol A-EO adduct | | | | | | | | | | |
| (Acid component) | | | | | | | | | | |
| Fumaric acid | 464 | 20 | | | | | | | | |
| Alkenyl succinic anhydride | | | | | | | | | | |
| Terephthalic acid | 2490 | 75 | 2722 | 82 | 2490 | 75 | 2324 | 70 | 2125 | 64 |
| Isophthalic acid | | | | | | | | | | |
| Trimellitic anhydride[2] | | 0 | 154 | 4 | 384 | 10 | 576 | 15 | 806 | 21 |
| (in carboxylic cid component) | | (0) | | (4.8) | | (11.8) | | (17.6) | | (24.7) |
| (Catalyst, etc.) | | | | | | | | | | |
| Tin (II) dioctylate | 22.4 | 0.5 | 22 | 0.5 | 22 | 0.5 | 22.1 | 0.5 | 22.3 | 0.5 |
| Gallic acid | 2.2 | 0.05 | 2.2 | 0.05 | 2.2 | 0.05 | 2.2 | 0.05 | 2.2 | 0.05 |
| Tert-butyl catechol | 2.2 | 0.05 | | | | | | | | |
| Properties | | | | | | | | | | |
| Acid value (mg KOH/g) | 20.1 | | 16.1 | | 20.1 | | 26.7 | | 29.5 | |

TABLE 7-continued

| | | | | | |
|---|---|---|---|---|---|
| Softening point (° C.) | 108.7 | 107.6 | 110.3 | 113.2 | 110.6 |
| Glass transition point (° C.) | 60.1 | 63.4 | 62.5 | 63.1 | 62.4 |
| Melting point, endothermic highest peak temperature (° C.) | 64.1 | 65.8 | 65.7 | 64.9 | 64.8 |
| Number-average molecular weight | 3100 | 2800 | 2500 | 2000 | 1600 |
| Weight-average molecular weight | 8700 | 9500 | 11000 | 15000 | 30000 |
| Components having a molecular weight of 1500 or less | 7% | 8% | 10% | 15% | 20% |
| Mw/Mn | 2.8 | 3.4 | 4.4 | 7.5 | 18.8 |

| | Shell Production Example | | | | | | | | | |
|---|---|---|---|---|---|---|---|---|---|---|
| | 18 | | 19 | | 20 | | 21 | | 22 | |
| | Resin | | | | | | | | | |
| | B6 | | B7 | | B8 | | B9 | | B10 | |
| Raw material monomers | Amount charged (g) | Molar ratio 1) | Amount charged (g) | Molar ratio 1) | Amount charged (g) | Molar ratio 1) | Amount charged (g) | Molar ratio 1) | Amount charged (g) | Molar ratio 1) |
| (Alcohol component) | | | | | | | | | | |
| 2,3-Butanediol | | | | | 900 | 50 | | | | |
| 1,2-Propanediol | 1520 | 100 | 1520 | 100 | 760 | 50 | | | 1520 | 100 |
| Neopentyl glycol | | | | | | | | | | |
| Ethylene glycol | | | | | | | | | | |
| 1,6-Hexanediol | | | | | | | | | | |
| Bisphenol A-PO adduct | | | | | | | 2450 | 70 | | |
| Bisphenol A-EO adduct | | | | | | | 975 | 30 | | |
| (Acid component) | | | | | | | | | | |
| Fumaric acid | | | 928 | 40 | | | | | | |
| Alkenyl succinic anhydride | | | | | | | | | | |
| Terephthalic acid | 2490 | 75 | 1162 | 35 | 2324 | 70 | 1079 | 65 | | |
| Isophthalic acid | | | | | | | | | 2490 | 75 |
| Trimellitic anhydride[2] (in carboxylic cid component) | 384 | 10 (11.8) | 384 | 10 (11.8) | 576 | 15 (17.6) | 384 | 20 | 384 | 10 |
| (Catalyst, etc.) | | | | | | | | | | |
| Tin (II) dioctylate | 22 | 0.5 | 20 | 0.5 | 22.8 | 0.5 | 24.4 | 0.5 | 22 | 0.5 |
| Gallic acid | 2.2 | 0.05 | 2 | 0.05 | 2.3 | 0.05 | 2.4 | 0.05 | 2.2 | 0.05 |
| Tert-butyl catechol | | | 2 | 0.05 | | | | | | |
| Properties | | | | | | | | | | |
| Acid value (mg KOH/g) | 29.7 | | 20.7 | | 23.9 | | 24.8 | | 21.4 | |
| Softening point (° C.) | 100.6 | | 106.9 | | 124.3 | | 123.7 | | 109.5 | |
| Glass transition point (° C.) | 54.5 | | 47.1 | | 68.5 | | 66.3 | | 60.3 | |
| Melting point, endothermic highest peak temperature (° C.) | 56.9 | | 49.6 | | 70.1 | | 69.5 | | 63.7 | |
| Number-average molecular weight | 2000 | | 2300 | | 2300 | | 3400 | | 2500 | |
| Weight-average molecular weight | 7000 | | 12000 | | 10000 | | 16000 | | 12000 | |
| Components having a molecular weight of 1500 or less | 18% | | 8% | | 18% | | 12% | | 10% | |
| Mw/Mn | 3.5 | | 5.2 | | 4.3 | | 4.7 | | 4.8 | |

Note

1) The values of molar ratios of tin (II) dioctylate, gallic acid and tert-butyl catechol were respectively "part(s) by mass" on the basis of 100 parts by mass of a total amount of an alcohol component and a carboxylic acid component to be subjected to polycondensation reaction.

2) The value in parenthesis represents a content (mass %) in a carboxylic acid component.

Production Examples 23 to 32

Preparation of Dispersion of Resin Particles

A 5 L container equipped with a stirrer, a reflux condenser, a dropping funnel, a thermometer and a nitrogen inlet tube was charged with 600 g of methyl ethyl ketone, and then 200 g of each of the amorphous resins A1 to A9, the crystalline polyester c1 and the amorphous resins B1 to B10 obtained in Production Examples 3 to 22 were added thereinto at 60° C. to dissolve the respective resins in methyl ethyl ketone. The thus obtained respective solutions were neutralized by adding 4 g of sodium hydroxide thereto. Successively, 2000 g of ion-exchanged water were added to the respective solutions, and then methyl ethyl ketone was distilled off therefrom while stirring at a rate of 250 r/min under reduced pressure at a temperature of 50° C. or lower, thereby obtaining aqueous dispersions of self-dispersible resin particles (resin content: 9.6% by mass (in terms of a solid content)). The volume median particle size of the resin particles dispersed in each of the thus obtained aqueous dispersions was about 0.3 μm.

Production Example 29

Preparation of Colorant Dispersion

Fifty grams of copper phthalocyanine (Model No.: "ECB-301" available from Dainichiseika Color & Chemicals Mfg. Co., Ltd.), 5 g of a nonionic surfactant (tradename: "EMULGEN 150" available from Kao Corp.) and 200 g of ion-exchanged water were mixed with each other. The resulting mixture was dispersed at 25° C. for 10 min using a homogenizer, thereby obtaining a colorant dispersion. The colorant particles contained in the thus obtained colorant dispersion had a volume median particle size of 120 nm.

Production Example 30

Preparation of Releasing Agent Dispersion

Fifty grams of a paraffin wax (tradename: "HNP 0190" available from NIPPON SEIRO Co., Ltd.; melting point: 85° C.), 5 g of a cationic surfactant (tradename: "SUNISOLE B50" available from Kao Corp.) and 200 g of ion-exchanged water were mixed and heated to 95° C., and then a paraffin wax was dispersed in the obtained mixture using a homogenizer. The resulting dispersion was subjected to dispersing treatment using a pressure injection type homogenizer, thereby obtaining a releasing agent dispersion. The releasing agent particles contained in the thus obtained releasing agent dispersion had a volume median particle size of 550 nm.

Production Example 31

Preparation of Charge Controlling Agent Dispersion

Fifty grams of a charge controlling agent (salicylic acid-based compound; tradename: "BONTRONE E-84" available from Orient Chemical Industries Co., Ltd.), 5 g of a nonionic surfactant (tradename: "EMULGEN 150" available from Kao Corp.) and 200 g of ion-exchanged water were mixed with each other. The resulting mixture was dispersed with glass beads using a sand grinder at 25° C. for 10 min to obtain a charge controlling agent dispersion. The charge controlling agent particles contained in the thus obtained charge controlling agent dispersion had a volume median particle size of 500 nm.

Examples 1 to 17 and Comparative Examples 1 to 4

Production of Dispersion of Core-Shell Resin Particles and Toner

A round stainless steel flask was charged with 500 g of the core resin dispersion which was formulated with combination of resins as shown in Table 8, 20 g of the colorant dispersion, 5 g of the releasing agent dispersion, 4 g of the charge controlling agent dispersion and 1.5 g of a cationic surfactant (tradename: "SUNISOLE B50" available from Kao Corp.). The contents of the flask were mixed and dispersed using a homogenizer, and then heated to 48° C. in a heating oil bath while stirring, and further held at 48° C. for about 1 h until a volume median particle size of the particles aggregated reached 5.1 μm, thereby forming aggregated particles. Thereafter, 150 g (Examples 1 to 7 and 9 to 17 and Comparative Examples 1 to 4) or 300 g (Example 8) of the shell resin dispersion as shown in Table 8 were added to the resulting reaction mixture, and the obtained dispersion was dispersed while stirring, thereby obtaining aggregated particles in the form of capsulated core-shell particles.

After adding 3 g of an anionic surfactant (tradename: "Plex SS-L" available from Kao Corp.) to the dispersion of the aggregated particles in the form of core-shell aggregated particles, a reflux tube was mounted to the stainless steel flask, and the dispersion was heated to 75° C. at a temperature rise rate of 0.1° C./min while continuously stirring and held at 75° C. for 2 h to coalesce and fuse the aggregated particles. Thereafter, the resulting dispersion was cooled and then filtered to separate the fused particles therefrom. The thus separated particles were sufficiently washed with ion-exchanged water and then dried, thereby obtaining colored resin fine particles. All of the thus obtained colored resin fine particles had a volume median particle size ($D_{50}$) of 5.0 μm.

Next, 100 parts by mass of the colored resin fine particles were mixed and externally added with 0.5 part by mass of an external additive (hydrophobic silica; tradename: "AEROSIL R-972" available from Nippon Aerosil Co., Ltd.; number-average particle size: 16 nm) using a Henschel mixer (available from Nippon Coke & Engineering Co., Ltd.) at 3600 r/min (peripheral speed: 31.7 m/s) for 5 min, thereby obtaining a toner composed of toner particles (volume median particle size $D_5O$: 5.0 μm).

[Evaluation]

<Low-Temperature Fusing Property>

The toner was loaded to a copying machine (tradename: "AR-505" available from Sharp Corp.) to print a toner image on an image fixing paper for evaluation of the toner. More specifically, a solid image printed on the paper was taken out before allowing the paper to pass through a fuser to thereby obtain an unfused image (printed area: 2 cm×12 cm; amount of the toner deposited: 0.5 mg/cm$^2$). The paper with the thus obtained unfused image was loaded again to a copying machine (tradename: "AR-505" available from Sharp Corp.) and then subjected to printing of a solid image two more times such that each solid image printed was taken out before allowing the paper to pass through the fuser, thereby obtaining a layered unfused image (three layers) having a layer thickness of 1.5 mg/cm$^2$.

With the fuser of the copying machine being held in an off-line condition, the three-layered unfused image was fused and fixed on the paper at a rate of 300 mm/s while increasing the fusing temperature from 90° C. to 240° C. at intervals of 5° C. Meanwhile, an image fixing standard paper (tradename: "Copy Bond SF-70NA" available from Sharp Corp.; 75 g/m$^2$) was used as the image fixing paper for evaluation of the toner.

The thus fused image obtained by passing the paper through the fuser was rubbed with a sand eraser having a bottom surface area of 15 mm×7.5 mm by reciprocating the eraser over the fused image 5 times while applying a load of 500 g thereto. Then, optical reflection density values of the fused image before and after the rubbing were measured using a reflection-type densitometer (tradename: "RD-915" available from Gretag Macbeth GmbH). From the thus measured values, a minimum fusing temperature of the toner was determined as the temperature of a fusing roll at which a ratio between the optical reflection density values of the fused image before and after the rubbing (optical density after rubbing/optical density before rubbing) first exceeded 80%. The lower the minimum fusing temperature, the more excellent the low-temperature fusing property of the toner became. The results are shown in Table 8.

(Heat-Resistant Storage Property)

Ten grams of the toner were charged into a 50 mL polymeric cup and stored under environmental conditions of 55° C. and 60% RH for 24 h. Thereafter, three sieves including a sieve A (mesh size: 250 μm), a sieve B (mesh size: 150 μm) and a sieve C (mesh size: 75 μm) were disposed on a powder tester (available from Hosokawa Micron Corp.) in an overlapped manner in the order of the sieve A, the sieve B and the sieve C from above, and 10 g of the toner were placed on the sieve A and vibrated for 60 s. The larger value (α) calculated according to the following formula indicates a more excellent fluidity and a more excellent heat-resistant storage property of the toner.

$$\alpha=100-(WA+WB\times0.6WC\times0.2)/10\times100$$

The term "WA" as used herein means the weight of the toner placed on the sieve A, the term "WB" as used herein means the weight of the toner placed on the sieve B, and the term "WC" as used herein means the weight of the toner placed on the sieve C.

(Durability)

The toner was loaded to a development device (tradename: "PAGEPRESTO N-4" available from Casio Computer Co., Ltd.; fusing: contact fusing method; development: non-magnetic one component development method; developing roll diameter: 2.3 cm), and a slanted stripe pattern having a print coverage of 5.5% was continuously printed on sheets of paper at a temperature of 32° C. and a humidity of 85%. The "a print coverage" as used herein means the area of the printing portion on the basis of the total area of the paper. In the course of continuously printing the stripe pattern, a black solid image was printed on the paper every 500 sheets to confirm whether or not any white streaks (or lines) occurred on the printed image. The printing was interrupted at the time at which the white streaks occurred on the image, although it was continued until reaching 9000 sheets in maximum unless any defects occurred. The number of sheets of paper printed up to the time at which the white streaks were first observed on the image by naked eyes was regarded as the number of sheets of paper printed which was capable of withstanding occurrence of white streaks owing to the toner fused and fixed on a developing roll, and was used to evaluate a durability of the toner. The larger the number of sheets of paper printed, the more excellent the durability of the toner became. The results are shown in Table 8.

TABLE 8

| | | Mixing | Core | | Shell | Difference between | Low temperature | Durability | Heat- |
|---|---|---|---|---|---|---|---|---|---|
| | Core/ shell | ratio of resins (mass ratio) | Softening point (TmA) (° C.) | Alkenyl succinic acid (mol parts)*1 | Softening point (TmB) (° C.) | softening points (TmA − TmB) (° C.) | fusing property Temperature (° C.) | Number of sheets of paper printed until white streaks | resistant storage property (α) |
| Example 1 | A1/B3 | 100/30 | 104.2 | 40 | 110.3 | −6.1 | 115 | 6000 | 98.8 |
| Example 2 | A1/B8 | 100/30 | 104.2 | 40 | 124.3 | −20.1 | 130 | 8000 | 99.7 |
| Example 3 | A2/B3 | 100/30 | 103.9 | 25 | 110.3 | −6.4 | 125 | 7000 | 99.4 |
| Example 4 | A3/B3 | 100/30 | 102.1 | 40 | 110.3 | −8.2 | 120 | 4000 | 76.1 |
| Example 5 | A4/B3 | 100/30 | 104.3 | 30 | 110.3 | −6.0 | 125 | 7000 | 99.2 |
| Example 6 | A6/B3 | 100/30 | 100.1 | 15 | 110.3 | −10.2 | 125 | 8000 | 99.4 |
| Example 7 | A7/B3 | 100/30 | 99.4 | 40 | 110.3 | −10.9 | 120 | 5000 | 81.0 |
| Example 8 | A1/B3 | 100/60 | 104.2 | 40 | 110.3 | −6.1 | 135 | 9000 | 99.4 |
| Example 9 | A9/B10 | 100/30 | 103.4 | 40 | 109.5 | −6.1 | 115 | 4500 | 76.5 |
| Example 10 | A1/B10 | 100/30 | 104.2 | 40 | 109.5 | −5.3 | 115 | 5000 | 80.2 |
| Example 11 | A9/B3 | 100/30 | 103.4 | 40 | 110.3 | −6.9 | 115 | 5000 | 81.3 |

Note

*1: Mol part(s) on the basis of 100 mol parts of an alcohol component of an amorphous resin in a core portion.

*2: The softening point value of the amorphous resin A7 only.

As shown in Table 8, in Comparative Examples 1 to 4, since no alkenyl succinic anhydride was used as a carboxylic acid component in the core portion, the resulting toners were insufficient in low-temperature fusing property.

Also, in Comparative Example 3, since the crystalline polyester was used in the core portion, the resulting toner was deteriorated in durability.

On the other hand, in Examples 1 to 17, the resulting toners were excellent in all of low-temperature fusing property, heat-resistant storage property and durability.

INDUSTRIAL APPLICABILITY

The toner according to the present invention is excellent in heat-resistant storage property, low-temperature fusing property and durability, and can be therefore suitably used as a toner for electrophotography which is employed in an electrophotographic method, an electrostatic recording method, an electrostatic printing method and the like.

The invention claimed is:

1. A toner for electrophotography comprising core-shell particles as a resin binder each comprising a core portion comprising an amorphous resin (A) having a softening point of 105° C. or lower which is obtained by polycondensing a carboxylic acid component comprising an alkenyl succinic acid in an amount of 10 mol % or more with an alcohol component; and a shell portion comprising an amorphous resin (B) obtained by polycondensing an alcohol component comprising an aliphatic diol having 2 to 6 carbon atoms with a carboxylic acid component comprising a trivalent or higher-valent polycarboxylic acid compound in an amount of from 1 to 20 mol %, wherein the amorphous resin (B) has a softening point higher, by not less than 1° C. but not more than 30° C., than the softening point of the amorphous resin (A).

2. The toner for electrophotography according to claim 1, wherein the alkenyl succinic acid is contained in an amount of 15 mol parts or more on the basis of 100 mol parts of the alcohol component of the amorphous resin (A).

3. The toner for electrophotography according to claim 1, wherein the alcohol component of the amorphous resin (A) comprises an aliphatic diol having 2 to 6 carbon atoms in an amount of from 80 to 100 mol %.

4. The toner for electrophotography according to claim 1, wherein the core portion contains no crystalline polyester.

5. The toner for electrophotography according to claim 1, wherein the amorphous resin (B) has a number-average molecular weight of from 1,000 to 6,000.

6. The toner for electrophotography according to claim 1, wherein the amorphous resin (B) has a weight-average molecular weight of from 8,000 to 100,000.

7. The toner for electrophotography according to claim 1, wherein the alcohol component of the amorphous resin (B) comprises an aliphatic diol having 2 to 6 carbon atoms in an amount of from 80 to 100 mol %.

8. The toner for electrophotography according to claim 1, wherein the alcohol component of the amorphous resin (A) is an aliphatic diol comprising a hydroxyl group bonded to a secondary carbon atom.

9. The toner for electrophotography according to claim 8, wherein the alcohol component of the amorphous resin (B) comprises an aliphatic diol having 2 to 4 carbon atoms in an amount of from 80 to 100 mol %.

10. The toner for electrophotography according to claim 1, wherein the alcohol component of the amorphous resin (B) is an aliphatic diol having 2 to 4 carbon atoms.

11. The toner for electrophotography according to claim 1, wherein the alcohol component of the amorphous resin (B) is an aliphatic diol comprising a hydroxyl group bonded to a secondary carbon atom.

12. The toner for electrophotography according to claim 1, wherein the alkenyl succinic acid is contained in an amount of from 25 to 60 mol parts on the basis of 100 mol parts of the alcohol component of the amorphous resin (A).

13. The toner for electrophotography according to claim 1, wherein the alkenyl succinic acid is contained in an amount of 5 mol % or more on the basis of the carboxylic acid component of the amorphous resin (A).

14. The toner for electrophotography according to claim 1, wherein the amorphous resin (B) comprises components having a molecular weight of 1500 or less in an amount of 20% by mass or less.

15. The toner for electrophotography according to claim 1, wherein the amorphous resin (B) has a molecular weight distribution of 30 or less.

16. The toner for electrophotography according to claim 1, wherein the carboxylic acid component of the amorphous resin (B) comprises an aromatic dicarboxylic acid compound in an amount of from 30 to 95 mol %.

17. The toner for electrophotography according to claim 1, wherein the carboxylic acid component of the amorphous resin (A) comprises an aromatic dicarboxylic acid compound in an amount of from 30 to 90 mol %.

18. The toner for electrophotography according to claim 1, wherein the trivalent or higher-valent polycarboxylic acid component contained in the amorphous resin (B) is a trimellitic acid compound.

19. A toner for electrophotography comprising core-shell particles as a resin binder each comprising a core portion comprising an amorphous resin (A) having a softening point of 105° C. or lower which is obtained by polycondensing a carboxylic acid component comprising an alkenyl succinic acid in an amount of 10 mol % or more with an alcohol component; and a shell portion comprising an amorphous resin (B) obtained by polycondensing an alcohol component comprising an aliphatic diol having 2 to 6 carbon atoms with a carboxylic acid component comprising a trivalent or higher-valent polycarboxylic acid compound in an amount of from 1 to 15/0.85 mol %, wherein the amorphous resin (B) has a softening point higher, by not less than 1° C. but not more than 30° C., than the softening point of the amorphous resin (A).

20. A process for producing a toner for electrophotography, comprising:

(i) subjecting a resin aqueous dispersion comprising an amorphous resin (A) having a softening point of 105° C. or lower which is obtained by polycondensing a carboxylic acid component comprising an alkenyl succinic acid with an alcohol component to an aggregation of the resin to obtain an aqueous dispersion of resin particles I;

(ii) preparing a resin aqueous dispersion comprising an amorphous resin (B) obtained by polycondensing an alcohol component comprising an aliphatic diol having 2 to 6 carbon atoms with a carboxylic acid component comprising a trivalent or higher-valent polycarboxylic acid compound in an amount of 20 mol % or less;

(iii) mixing the aqueous dispersion of the resin particles I obtained in said (i) subjecting with the resin aqueous dispersion obtained in said (ii) preparing to aggregate the resin particles I and the amorphous resin (B), thereby preparing an aqueous dispersion of resin particles II; and (iv) coalescing said resin particles II obtained from said (iii) mixing.

21. The toner for electrophotography according to claim 1, wherein the shell portion comprises an amorphous resin (B) obtained by polycondensing an alcohol component comprising an aliphatic diol having 2 to 6 carbon atoms with a carboxylic acid component comprising a trivalent or higher-valent polycarboxylic acid compound in an amount of from 5 to 20 mol %.

* * * * *